US010870988B2

(12) United States Patent
Keith et al.

(10) Patent No.: US 10,870,988 B2
(45) Date of Patent: Dec. 22, 2020

(54) TIE FOR COMPOSITE WALL SYSTEM FITTING BETWEEN INSULATION SHEETS

(71) Applicant: HK MARKETING LC, American Fork, UT (US)

(72) Inventors: David O. Keith, American Fork, UT (US); Jordan O. Keith, Saratoga Springs, UT (US); Sidney E. Francies, Lithia, FL (US)

(73) Assignee: HK Marketing LC, American Fork, UT (US)

( * ) Notice: Subject to any disclaimer, the term of this patent is extended or adjusted under 35 U.S.C. 154(b) by 0 days.

(21) Appl. No.: 16/267,718

(22) Filed: Feb. 5, 2019

(65) Prior Publication Data

US 2019/0234072 A1 Aug. 1, 2019

Related U.S. Application Data

(63) Continuation-in-part of application No. 29/635,189, filed on Jan. 29, 2018, now Pat. No. Des. 856,121, (Continued)

(51) Int. Cl.
*E04C 2/288* (2006.01)

(52) U.S. Cl.
CPC ..... *E04C 2/288* (2013.01); *E04B 2103/02* (2013.01)

(58) Field of Classification Search
CPC ..... E04C 2/288; E04C 2002/047; E04C 2002/046; E04B 2103/02
See application file for complete search history.

(56) References Cited

U.S. PATENT DOCUMENTS

D35,565 S * 1/1902 Godfrey ..... D8/384
1,511,711 A 10/1924 Atwell
(Continued)

FOREIGN PATENT DOCUMENTS

CA 2392892 1/2003
CN 203891249 10/2014
(Continued)

OTHER PUBLICATIONS

U.S. Appl. No. 14/841,260, Dec. 15, 2017, Office Action.
(Continued)

*Primary Examiner* — Rodney Mintz

(57) ABSTRACT

Ties and related methods for making insulating composite wall structures including first and second structural layers comprising a hardenable material and an insulating layer having a high thermal resistance disposed between the structural layers. The insulating layer is formed from a plurality of insulating sheets, where the sheets are sandwiched between the structural layers of the wall. During wall construction, the tie is configured to be advanced into the first structural layer before it has hardened, with the tie fitting between adjacent sheets of insulation. No pre-drilling of holes through the sheets, or screwing or pressing of the ties through the actual sheets is required. Each tie includes generally planar features to accommodate such placement, with a penetrating segment, an impact segment, and a mesial segment therebetween. At least the penetrating and mesial segments are generally planar in shape, as they are advanced into such a gap between insulation sheets.

21 Claims, 12 Drawing Sheets

Related U.S. Application Data and a continuation-in-part of application No. 29/656,554, filed on Jul. 13, 2018, now Pat. No. Des. 856,122.

(60) Provisional application No. 62/627,097, filed on Feb. 6, 2018.

(56) References Cited

U.S. PATENT DOCUMENTS

| | | | |
|---|---|---|---|
| 1,736,704 | A | 11/1929 | Gilbert |
| 1,876,683 | A | 9/1932 | Johnson et al. |
| 2,236,082 | A | 6/1939 | Wright |
| 2,645,929 | A | 12/1948 | Jones |
| 2,819,863 | A | 1/1958 | Vines |
| D189,259 | S | 11/1960 | Hughes |
| D214,086 | S | 5/1969 | Powell |
| 4,018,023 | A | 4/1977 | Anderson |
| 4,329,826 | A | 5/1982 | Flogaus |
| 4,393,635 | A | 7/1983 | Long |
| 4,545,163 | A | 10/1985 | Asselin |
| D284,267 | S | 6/1986 | Lindell |
| D286,180 | S | 10/1986 | Korthoff |
| 4,627,198 | A | 12/1986 | Francies, III |
| 4,754,758 | A | 7/1988 | Li |
| D298,916 | S | 12/1988 | Beatty |
| 4,829,733 | A | 5/1989 | Long |
| 4,846,655 | A | 7/1989 | Gulley |
| 4,994,073 | A | 2/1991 | Green |
| 5,011,354 | A | 4/1991 | Browniee |
| 5,223,675 | A | 6/1993 | Taft |
| 5,390,459 | A | 2/1995 | Mensen |
| D357,855 | S | 5/1995 | Keith et al. |
| 5,415,507 | A | 5/1995 | Janusz et al. |
| 5,433,558 | A | 7/1995 | Gray |
| D361,710 | S | 8/1995 | Boeshart |
| 5,509,636 | A | 4/1996 | Cotugno |
| 5,519,973 | A | 5/1996 | Keith et al. |
| 5,570,983 | A | 11/1996 | Hollander |
| 5,588,263 | A | 12/1996 | Kelly et al. |
| D378,049 | S | 2/1997 | Boeshart |
| 5,606,832 | A | 3/1997 | Keith et al. |
| 5,623,804 | A | 4/1997 | Kelly et al. |
| D383,373 | S | 9/1997 | Boeshart |
| 5,671,574 | A | 9/1997 | Long |
| 5,673,525 | A | 10/1997 | Keith et al. |
| 5,692,356 | A | 12/1997 | Baxter |
| 5,809,723 | A | 9/1998 | Keith et al. |
| 5,830,399 | A | 11/1998 | Keith et al. |
| 5,890,337 | A | 4/1999 | Boeshart |
| 5,996,297 | A | 12/1999 | Keith et al. |
| 6,079,176 | A | 6/2000 | Westra |
| 6,112,491 | A | 9/2000 | Keith et al. |
| 6,116,836 | A | 9/2000 | Long |
| 6,138,981 | A | 10/2000 | Keith et al. |
| D436,018 | S | 1/2001 | Boeshart |
| D436,674 | S | 1/2001 | Lancelot, III |
| D437,063 | S | 1/2001 | Lancelot, III |
| D438,649 | S | 3/2001 | Lancelot, III |
| D438,991 | S | 3/2001 | Lancelot, III |
| 6,308,484 | B1 | 10/2001 | Severino |
| 6,314,697 | B1 | 11/2001 | Moore |
| 6,460,824 | B1 | 10/2002 | Lancelot, III |
| 6,511,252 | B1 | 1/2003 | Andros |
| 6,647,674 | B1 | 11/2003 | Lancelot, III |
| D484,032 | S | 12/2003 | Del Re |
| 6,729,079 | B2 | 5/2004 | Francies, III |
| 6,854,229 | B2 | 2/2005 | Keith et al. |
| 6,895,720 | B2 | 5/2005 | Keith |
| 7,032,357 | B2 | 4/2006 | Cooper |
| 7,266,931 | B2 | 9/2007 | Long |
| D581,776 | S | 12/2008 | Yin-Feng |
| D614,942 | S | 5/2010 | Gaudron |
| 8,109,706 | B2 | 2/2012 | Richards |
| 8,365,501 | B2 | 2/2013 | Long |
| 8,677,697 | B2 | 3/2014 | Eklund et al. |
| 8,695,287 | B1 | 4/2014 | Francies, III |
| 8,696,284 | B2 | 4/2014 | Aicher |
| 8,745,943 | B2 | 6/2014 | Ciuperca |
| 8,800,220 | B1 | 8/2014 | Francies, III |
| 8,863,469 | B2 | 10/2014 | Curtis et al. |
| 8,898,964 | B1 | 12/2014 | Francies, III |
| 8,910,445 | B2 | 12/2014 | Hohmann |
| D728,044 | S | 4/2015 | Boatwright |
| 9,151,065 | B1 | 10/2015 | Francies, III |
| 9,169,635 | B2 | 10/2015 | Andrews |
| D744,646 | S | 12/2015 | Nering et al. |
| 9,303,404 | B2 | 4/2016 | Naito et al. |
| 9,347,232 | B1 | 5/2016 | Francies, III |
| D764,266 | S | 8/2016 | Keith et al. |
| 9,493,946 | B2 * | 11/2016 | Foderberg ..... E04C 2/049 |
| D773,926 | S | 12/2016 | Sweeney |
| 9,617,746 | B1 | 4/2017 | Francies, III |
| 9,637,925 | B2 | 5/2017 | Francies, III |
| 9,638,353 | B2 | 5/2017 | Francies, III |
| 9,803,354 | B1 | 10/2017 | Francies, III |
| D804,288 | S | 12/2017 | Keith et al. |
| 10,000,928 | B2 | 6/2018 | Keith et al. |
| 10,132,080 | B2 * | 11/2018 | Jensen ..... E04B 1/41 |
| 10,240,356 | B2 * | 3/2019 | MacKay Sim ..... E04G 21/142 |
| D856,121 | S * | 8/2019 | Keith ..... E04G 21/142 D8/384 |
| D856,122 | S * | 8/2019 | Keith ..... E04G 21/142 D8/384 |
| D887,258 | S * | 6/2020 | Keith ..... D8/384 |
| 2002/0026761 | A1 | 3/2002 | Moore |
| 2002/0092253 | A1 | 7/2002 | Beliveau |
| 2002/0096619 | A1 | 7/2002 | Lancelot, III |
| 2003/0019169 | A1 | 1/2003 | Francies, III |
| 2003/0140590 | A1 | 7/2003 | Lancelot, III |
| 2003/0208968 | A1 | 11/2003 | Lancelot, III |
| 2003/0208969 | A1 | 11/2003 | Lancelot, III |
| 2003/0208987 | A1 | 11/2003 | Lancelot, III |
| 2004/0010985 | A1 | 1/2004 | Francies, III |
| 2004/0055247 | A1 | 3/2004 | Keith |
| 2004/0118067 | A1 | 6/2004 | Keith |
| 2004/0136803 | A1 | 7/2004 | Grosch |
| 2004/0237438 | A1 | 12/2004 | Keith et al. |
| 2005/0016095 | A1 | 1/2005 | Long |
| 2006/0032166 | A1 | 2/2006 | Devalapura |
| 2006/0059847 | A1 | 3/2006 | Rice |
| 2006/0096197 | A1 | 5/2006 | Tollefson |
| 2007/0094974 | A1 | 5/2007 | Velickovic |
| 2009/0013631 | A1 * | 1/2009 | Devalapura ..... B32B 3/10 52/513 |
| 2009/0185880 | A1 | 7/2009 | Gong et al. |
| 2011/0094176 | A1 | 4/2011 | Bronner |
| 2012/0266560 | A1 | 10/2012 | Panasik et al. |
| 2013/0074433 | A1 | 3/2013 | Ciuperca |
| 2013/0153628 | A1 | 6/2013 | Euteneuer |
| 2013/0180192 | A1 | 7/2013 | Crosby |
| 2013/0218177 | A1 | 8/2013 | Miksze et al. |
| 2013/0326980 | A1 | 12/2013 | Hilliard |
| 2014/0260034 | A1 | 9/2014 | Ciuperca |
| 2014/0260055 | A1 | 9/2014 | Pfeiffer |
| 2015/0184383 | A1 * | 7/2015 | Foderberg ..... E04C 2/049 52/405.1 |
| 2015/0218806 | A1 | 8/2015 | Cossette |
| 2016/0010330 | A1 | 1/2016 | Naito |
| 2016/0123012 | A1 | 5/2016 | Francies, III |
| 2016/0123501 | A1 | 5/2016 | Francies, III |
| 2016/0215511 | A1 | 7/2016 | Salekarr |
| 2017/0058520 | A1 | 3/2017 | Keith |

(56) References Cited

U.S. PATENT DOCUMENTS

| | | | | |
|---|---|---|---|---|
| 2017/0204895 | A1 | 7/2017 | Rodenhouse | |
| 2018/0187436 | A1* | 7/2018 | Mackay Sim | E04G 21/142 |
| 2018/0238053 | A1 | 8/2018 | Jensen | |

FOREIGN PATENT DOCUMENTS

| | | |
|---|---|---|
| JP | 2004225265 | 8/2004 |
| RU | 131396 | 8/2013 |

OTHER PUBLICATIONS

U.S. Appl. No. 14/841,260, Apr. 13, 2018, Notice of Allowance.
BA Screw Threads Data Chart Accessed Jul. 24, 2016.
Photograph of competing tie, based on information and belief, photographed Jan. 30, 2019.
Questions and Answers about System SC for Structurally Composite Concrete Sandwich Walls. Boone: Thermomass System SC, 2012. Print.
Thermomass. "Insulated Cast-in-Place Construction Using Thermomass System CIP." Online video clip. YouTube. YouTube, Mar. 20, 2012. Web. Accessed Jan. 22, 2016. <https://www.youtube.com/watch?v=VoHzDS9Yuwc>.
Thermomass. Thermomass System SC, n.d. Web. Accessed Jan. 22, 2016. <http://www.thermomass.com/>.
U.S. Appl. No. 14/841,260, Jan. 15, 2016, Office Action.
U.S. Appl. No. 29/531,564, Apr. 18, 2016, Notice of Allowance.
U.S. Appl. No. 14/841,260, Jul. 29, 2016, Final Office Action.
U.S. Appl. No. 14/841,260, Jun. 6, 2017, Office Action.
U.S. Appl. No. 29/562,534, Oct. 16, 2017, Notice of Allowance.
U.S. Appl. No. 29/635,189, Jan. 11, 2019, Office Action.
U.S. Appl. No. 29/656,554, May 7, 2019, Notice of Allowance.

* cited by examiner

TIE FOR COMPOSITE WALL SYSTEM FITTING BETWEEN INSULATION SHEETS

CROSS-REFERENCE TO RELATED APPLICATIONS

The present application claims the benefit of U.S. Patent Application Ser. No. 62/627,097, filed Feb. 6, 2018 and entitled "TIE FOR COMPOSITE WALL SYSTEM FITTING BETWEEN INSULATION SHEETS". The present application is also a continuation-in-part of U.S. patent application Ser. No. 29/635,189, filed Jan. 29, 2018, entitled "COMPOSITE ACTION TIE". The present application is also a continuation-in-part of U.S. patent application Ser. No. 29/656,554, filed Jul. 13, 2018, entitled "TIE". The disclosure of each of the foregoing applications is herein incorporated by reference in its entirety.

BACKGROUND OF THE INVENTION

1. The Field of the Invention

The present invention relates to composite wall structures and, more specifically to the field of connectors used to secure together multiple layers of material within the composite wall structures.

2. The Relevant Technology

As new materials and compositions have been developed, apparently unrelated materials have been synergistically combined to form useful composite materials. One such example is seen in the area of building and construction, in which high strength structural walls have been coated or layered with highly insulative materials, which insulative materials generally have relatively low structural strength. The resulting composite wall structure has high strength and is highly insulative. In some conventional implementations, the structural component of such a wall is built first, after which the insulating layer or sheet is attached to the structural component. Thereafter a protective cover is placed over the insulating material to protect and hide it. In other implementations, the insulating layer is sandwiched between high strength layers. The insulating barrier reduces the transfer of thermal energy across the composite wall structure.

Concrete is one of the least expensive and strongest materials commonly used in the construction industry. Unfortunately, concrete, which is a mixture of hydraulic cement, water, and an aggregate such as rocks, pebbles, and sand, offers relatively poor insulation compared to many other materials. For example, a slab of concrete having an 8 inch thickness has an R value of only about 0.64, while a one-inch thick panel of expanded polystyrene foam has an R value of about 5.0. The R value of a material is proportional to the thermal resistance of the material and is useful for comparing the insulating properties of materials used in the construction industry.

In contrast to concrete, highly insulative materials, at least those of reasonable cost, typically offer poor structural strength and integrity. While lightweight aggregates having higher insulating ability may be incorporated within concrete to increase the insulating effect thereof, the use of such aggregates in an amount that has a dramatic effect on the insulation ability of the concrete will usually result in greatly decreased strength of the resulting structure.

It has been found that positioning at least one concrete layer adjacent to at least one insulating layer provides a composite wall structure that has both good insulating capability and good structural strength. One strategy for forming these composite wall structures is to position an insulating layer between two concrete layers. This technique, however, poses the risk of allowing the two concrete layers to collapse together or to separate apart during construction or subsequent use of the building. Accordingly, it is necessary to structurally bridge or connect the two concrete layers together. This is conventionally accomplished by using metal casting form ties.

Because metal readily conducts thermal energy, metal casting form ties that are used to structurally bridge a pair of structural layers have the effect of significantly reducing the insulating properties of a composite wall. In particular, such casting form ties provide channels through which thermal energy may be conducted. This is true even though the ties may be surrounded by ample amounts of insulating material. Composite wall structures that use metal casting form ties do not prevent heat from flowing from a relatively warm inside wall to a colder outside wall during cold weather, for example, as effectively as composite walls that do not use metal casting form ties. Of course one might construct a building having no structural bridges between the inner and outer structural walls, although the result would be a building having inadequate stability for most needs.

In order to reduce thermal bridging, some have employed casting form ties having a metal portion that passes through the concrete layers and a thermally insulating portion that passes through the insulating layer, e.g., U.S. Pat. No. 4,545,163 to Asselin. Others have developed casting form ties that may be formed from polymeric or other highly insulative materials. Examples of the foregoing include U.S. Pat. Nos. 4,829,733 and 6,116,836 to Long; and Applicant's own earlier U.S. Pat. Nos. 5,519,973; 5,606,832; 5,673,525; 5,830,399; 6,138,981, 6,854,229; 6,895,720; and 10,000,928, each to Keith. For purposes of disclosing insulating casting form ties used to secure a composite wall structure together, each of the foregoing patents are incorporated herein by specific reference. Furthermore, any patents, publications or other references mentioned herein are also specifically incorporated by reference herein.

One technique for forming composite wall structures is known in the art as the "tilt-up" method, wherein the wall is formed horizontally (e.g., on the ground). The first structural layer is poured, the insulating layer is positioned thereover, and insulating or metal ties having a length that is more than, equal to, or less than the width of the composite wall structure are placed substantially orthogonally through the insulating layer, into the first structural layer, which is not yet hardened. The opposite end of the ties stick up through the insulating layer. The second structural layer is then poured over the insulating layer, and allowed to harden. Once the composite wall structure has hardened, it may be tilted up to the desired vertical orientation and secured in place.

Another technique for forming composite wall structures is known in the art as the "cast-in-place" method, wherein the wall is formed within vertically positioned casting forms that are erected at or near the location where the composite wall structure is to be finally positioned. In the cast-in-place method the forms and insulating layer are first positioned vertically, after which concrete or other structural material is poured into the spaces between the insulating layer and casting forms. Insulating or metal casting form ties having a length that is more than, equal to or less than the width of the composite wall structure are placed substantially orthogonally through a vertically oriented insulating layer, with the ends of the ties extending out of either surface of the insulating layer. The opposite ends of the ties become anchored within the structural layers once those layers harden.

BRIEF SUMMARY

The present disclosure relates to ties for use in making insulating composite wall structures including first and second structural layers comprising hardenable material (e.g., concrete) and an insulating layer (e.g., sheets of expanded polystyrene) having a higher thermal resistance than the structural layers, disposed between the first and second structural layers. The present ties are particularly configured for placement in between adjacent sheets of the insulating layer, rather than penetration (and damage to) the sheets of the insulation layer itself. This placement of the ties between insulation sheets provides an advantageous alternative, which often can offer faster tie placement, prevents formation of holes or damage through the insulating layer, and can allow construction personnel to use locally sourced generic insulating layers, e.g., rather than requiring damage to the layers, or production or shipping of custom perforated sheets configured to receive typical ties.

The tie may include a generally planar body including first and second generally planar shaft bodies or body portions (e.g., as opposed to cylindrical bodies intended for screwing or other rotation into the insulating layer). Each generally planar shaft body or body portion may include a penetrating segment, an impact segment, and a mesial segment extending between the penetrating and impact segments. In other words, the generally planar body includes a pair of penetrating segments, a pair of impact segments, and a pair of mesial segments. The mesial segments of the two generally planar shaft bodies may be joined to one another by a bridging web (e.g., also generally planar) that bridges between the first and second planar shaft bodies or body portions.

By generally planar, it is meant that the generally planar shaft bodies or body portions are generally within a single plane, although there may be some structures or components that protrude from the planar body in a lateral direction (i.e., in the direction into or out of the wall). Nevertheless, such lateral protrusion outward from the defined plane is relatively limited, e.g., so as to extend laterally outward no more than 10%, no more than 5%, no more than 3%, or no more than 2%, as compared to the length or width of the tie. In other words, the tie has a generally "flat" appearance, with some minor possible lateral or outwardly protruding structures or components, but is generally planar. The width to thickness aspect ratio of the tie is relatively high, e.g., far higher than many typical ties. For example, such aspect ratio may be at least 5:1, or at least 10:1, such as 10:1 to 100:1, or 10:1 to 50:1. For example, the generally planar ties seen in the accompanying Figures have aspect ratios of about 14:1 (FIG. 6), and about 50:1 (FIG. 1). The shape associated with this aspect ratio is an important characteristic in allowing the tie to extend over a significant length of a wall portion (i.e., provided by the width of the tie), while the tie is very thin, so as to fit between adjacent positioned insulating sheets (which minimizes the distance of any gap between adjacent insulating sheets). Such gap may be no more than about 0.5 inch, for example. Any such small gap may be filled with a spray-in type foam insulating material, or a strip of EPS foam, for example.

For example, the planar shaft bodies may have a thickness of about 0.0625 inch to 0.5 inch, or 0.125 inch to 0.4 inch, or 0.125 to 0.25 inch, while the overall length and/or width of the tie may be far greater, e.g., from 5 inches to 20 inches, from about 6 inches to about 20 inches, for example. FIGS. 6 and 1 may have widths of 5 inches and 8 inches, respectively, with thicknesses of about 0.35 inch and about 0.15 inch, respectively. The tie may thus be generally planar, or in other words, largely 2-dimensional (where the thickness is minimal compared to the length and width). Such 2-dimensionality characteristics may apply particularly to the penetrating segment(s) and the mesial segment(s). Although such may also apply to the impact segment(s), this is less important, as the impact segment does not need to be pressed into the small gap between adjacent sheets of the insulating layer, but remains thereabove, on the side of the insulating layer where the workers are installing such ties.

In addition to the generally planar shaft bodies that are joined together by the bridging web, the tie may further include a pointed tip at each end of the two penetrating segments, for penetrating between adjacent sheets of the insulating layer. The pointed tips may also be generally planar, being generally flat spikes, as opposed to a pointed tip that may emanate from a cylindrical body (e.g., a conical pointed tip). While such tapered cylindrical or conical bodies may be appropriate where a tie is to be screwed or otherwise rotated through an insulating layer, or even pressed through such a layer, the present ties are rather configured to include generally planar pointed tips, which can be pressed into the uncured concrete of the first structure layer, without rotating the tie, and without breaking the insulating layer, by positioning the tie between adjacent sheets of the insulating layer. The thinness and extended width of the tie is particularly beneficial, as the ties are pressed into the first structural layer between adjacent sheets of the insulating foam layer, e.g., where the gap provided between such foam sheets may be no more than 0.5 inch, or no more than about 0.25 inch (e.g., just enough to accommodate the width of the thin, generally planar tie).

Another aspect of the present disclosure is directed to a method of installation of the present ties, and an associated method for manufacturing an insulating composite wall structure including first and second structural layers and an insulating layer disposed between the first and second structural layers. The method may include providing a generally planar tie as described herein, forming a first structural layer from a hardenable high strength structural material (e.g., concrete), and positioning an insulating layer comprising a material having a higher thermal resistance than the first structural layer against or onto a surface of the first structural layer while the first structural layer is in a substantially unhardened state. One or more of the present ties are axially pushed (not screwed) into the uncured first structural layer, with the ties positioned so as to be between adjacent sheets of the insulating layer. For example, the insulating layer may typically be formed by laying large sheets of such foam (e.g., in widths and/or lengths of typically 4×8 feet, although it will be appreciated that other sheet dimensions for length or width are possible, e.g., 2 feet, 4 feet, 8 feet, 12 feet, etc.) over the uncured first structural layer. The present ties are advantageously pressed into the uncured first structural layer, positioned between adjacent sheets of insulating foam. The ties thus do not damage or otherwise penetrate through the foam sheets themselves, but only penetrate through the insulating layer in the sense that they are positioned at the seams of adjacent insulating sheets of the insulating layer.

No damage is thus done to the insulating sheets. Nor do the sheets require pre-drilling of holes therethrough for receipt of the ties.

In any case, once the ties are in place between the sheets of insulation, the second structural layer may be formed (e.g., poured) over the exposed face of the insulating layer. Such formation is done in a way that at least a substantial portion of the impact segments of the tie extending from between the sheets of the insulating layer become embedded within the second structural layer. Because the ties are not actually pressed or otherwise advanced through the sheets of the insulating layer (but between adjacent sheets), it is possible to place at least some of the ties prior to placement of the insulation sheets, although a preferred method is to place the insulation sheets with a small gap (e.g., 0.125 to 0.5 inch) between such sheets, and then to press the generally planar pointed tips of the ties through such gap, between adjacent sheets. The gaps may be filled with an expanding insulating foam, by placement of EPS foam strips into the gap, or the like, if desired.

The penetrating segment of the tie becomes positioned within at least a portion of the first structural layer while that layer is unhardened, so as to become embedded substantially within the first structural layer. The penetrating segment is disposed substantially within the first structural layer, and a substantial portion of the impact segment (e.g., all of it) extends from the exposed surface of the insulating layer. The second structural layer of hardenable high strength material (e.g., concrete) is formed (e.g., poured) against or on the exposed surface of the insulating layer such that the portion of the impact segment extending outwardly past the insulating layer is embedded within the second structural layer. Where a cast-in-place method is employed, the high strength structural layers may be poured simultaneously (e.g., equalizing pressure on either side of the sheets of the insulating layer). In such a cast-in-place method, the ties may be placed whenever convenient relative to pouring of the structural layers into forms with the insulating layer therebetween. In an embodiment, the ties may be placed before pouring (e.g., with the sheets of the insulating layer placed first). The hardenable structural layers are allowed to harden, forming the insulating composite wall structure in which the first structural layer and the second structural layer are secured together by the one or more ties, with the sheets of the insulating layer sandwiched therebetween.

Such methods may be used to manufacture the wall by a tilt-up method, a cast-in-place method, or any other desired method. For at least a cast-in-place method, the first and second structural layers could be poured (e.g., filling of the form cavities) at substantially the same time. For a tilt-up method, typically, the bottom structural layer will be poured first, followed by placement of the insulating layer thereover, followed by placement of the ties between adjacent sheets of the insulating layer, followed by pouring of the second structural layer. Spacing of the ties may thus depend on the width of the sheets of the insulating layer, and vice-versa. The particular spacing selected and the width of the sheets used may depend on the strength characteristics desired in the finished wall. Closer placement of ties (and narrower insulation sheet widths) may result in greater strength. A typical spacing and sheet width may be 4 feet. Spacing of the ties may thus be 4 feet apart in one dimension (e.g., horizontally, where the sheets are 4 feet wide horizontally), and up to 4 feet apart vertically (e.g., from continuous to 4 feet apart). Of course, the foam panels may be oriented horizontally, rather than vertically, to alter the correspondence between vertical and horizontal placement axes.

Another aspect of the present disclosure is directed to an insulating composite wall structure including a first structural layer formed of a hardened or hardenable high strength structural material, a second structural layer formed of a hardened or hardenable high strength structural material, and an insulating layer having a higher thermal resistance than the first and second structural layers, disposed between the first and second structural layers. The structural layers may be secured to one another, with the insulating layer therebetween, by one or more ties such as those disclosed herein, with the ties positioned between adjacent sheets of the insulating layer.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

I. Introduction

The present invention relates to ties for use in making insulating composite wall structures including first and second structural layers comprising a hardenable material (e.g., concrete) and an insulating layer having a higher thermal resistance than the structural layers, disposed between the first and second structural layers. The insulating layer is made up of sheets of insulating foam that are laid over the first structural layer, e.g., while the first structural layer is still not hardened. The tie is particularly configured so as to be generally planar, with minimal thickness as compared to its length and/or width, allowing the tie to easily be inserted between adjacent insulating sheets of the insulating layer. Because the tie is inserted into the wall structure between adjacent sheets of the insulating layer, no pre-drilling is required in preparing the insulating layer sheets to receive the ties. Furthermore, because the ties do not actually penetrate through the sheets themselves (but are rather positioned between adjacent edges of separate foam insulating sheets), there is reduced risk of damaging the foam insulating layer when installing the ties. Such reduced damage may provide an incremental improvement in insulating characteristics of the wall.

The tie may include a generally planar body or body portions with first and second (e.g., left and right) generally planar shaft bodies or body portions. Each generally planar shaft body or body portion may include a penetrating segment, an impact segment, and a mesial segment extending therebetween. More particularly, at least the penetrating segments and mesial segments of the tie are generally planar, as these portions of the tie actually pass between adjacent insulating sheets. While the impact segment may also be generally planar, this is not necessary, as the impact segment does not pass between such sheets, but remains on the side of the sheet it began on, during use. In other words, the generally planar ties may include two penetrating segments, two impact segments, and two mesial segments. A bridging web is provided that bridges between the first and second planar shaft bodies or body portions, connecting for example the two mesial segments. In an embodiment, the two penetrating segments may not be connected to one another (but through the bridging web connecting the mesial segments). Similarly, the two impact segments may not be connected to one another (only through the bridging web that connects the mesial segments). In another example (e.g., FIGS. 6A-7), the bridging web may connect and bridge across two of the 3, or even all 3 corresponding portions, from left to right (e.g., connecting the left and right penetrating segments, the left and right mesial segments, and the left and right impact segments)

II. Exemplary Ties

Figure 1:
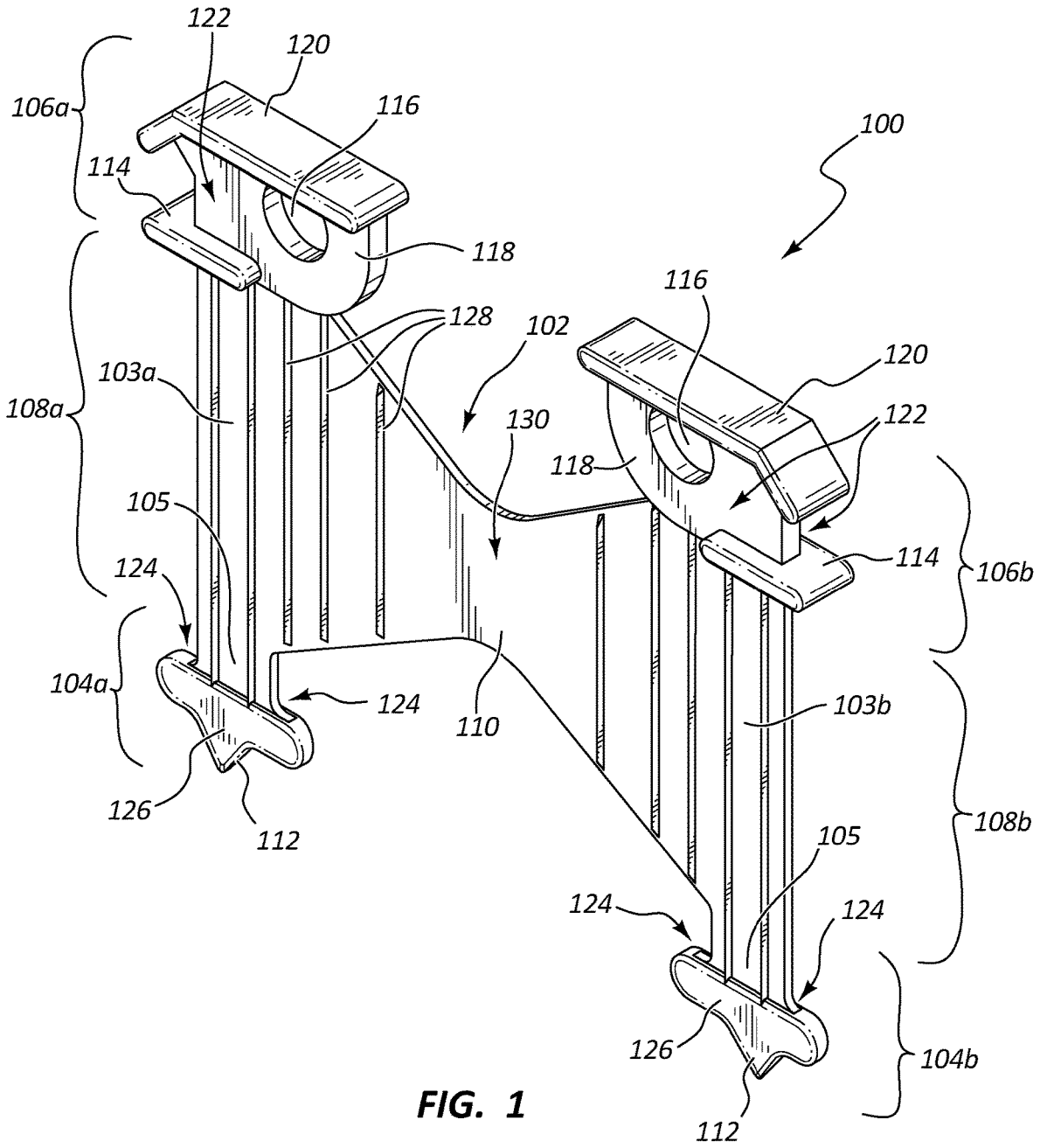
FIG. 1 is a perspective view of a generally planar insulating tie including features of the present disclosure.

FIG. 1 shows a perspective view of an exemplary tie 100. Tie 100 may include a body 102 that is generally planar. In fact, the entire tie itself may be regarded as generally planar, so as to include a thickness that is far less than its length and/or width. This may be particularly true of the mesial and penetrating segments of the tie 100. For example, the tie (or at least these portions) may have a thickness of only less than ½ inch, such as less than about ¼ inch, or even ⅛ inch, while its length and width may be at least 6-10 inches. While the mesial and penetrating segments and bridging web of tie 100 may thus be quite thin, the tie 100 is shown as including a limited number of structures or components which are somewhat thicker, e.g., up to about 1 inch, or up to about 0.5 inch (e.g., up to 2×, 3×, or 4× the thickness of the planar mesial and penetrating segments, and the web). Tie 100 is shown as including generally planar body 102, which includes first and second generally planar shaft bodies 103*a* and 103*b*, e.g., positioned on opposite far sides (e.g., left and right) of body 102. Each generally planar shaft body 103*a*, 103*b* includes a penetrating segment (e.g., 104*a*, 104*b*), an impact segment (106*a*, 106*b*), and a mesial segment (108*a*, 108*b*) extending therebetween. The mesial segments 108*a*, 108*b* are joined to one another by a bridging web 110 that bridges between the first and second planar shaft bodies 103*a*, 103*b*. As shown, each penetrating segment 104*a*, 104*b* may include a flattened, generally planar pointed tip 112 (e.g., as opposed to a conical, non-planar pointed tip emanating from a cylindrical base).

The thin, generally planar characteristics of the tie, particularly in the penetrating segments and mesial segments, facilitate insertion of the tie 100 between adjacent sheets of foam, of an insulating layer of the composite wall structure being constructed. For example, the mesial segments 103*a*, 103*b* and penetrating segments 104*a*, 104*b* may include no structures having a thickness greater than about 0.5 inch, 0.4 inch, or 0.25 inch, as these segments are advanced past (in the case of mesial segments 103*a*, 103*b*), or reside against (in the case of mesial segments 103*a*, 103*b*) the adjacent foam sheets of the insulating layer. The impact segments 106*a*, 106*b* may include greater width, and may include geometries that are not generally planar, as these segments do not pass or reside in the same plane as the insulating layer, but are always disposed above the insulating layer, so as to become embedded in the second structural layer of the composite wall structure being formed. That said, in an embodiment, even the impact segments may not be particularly thick relative to the length and/or width dimensions of the impact segments of the tie, but may have a thickness to structures included in these segments of no more than about 1 inch, or no more than 0.5 inch at their widest point (e.g., as compared to a width between from impact segment 106*a* to impact segment 106*b* that is at least 4 inches, 5 inches, or 6 inches (e.g., 5 to 10 inches).

Figure 2:
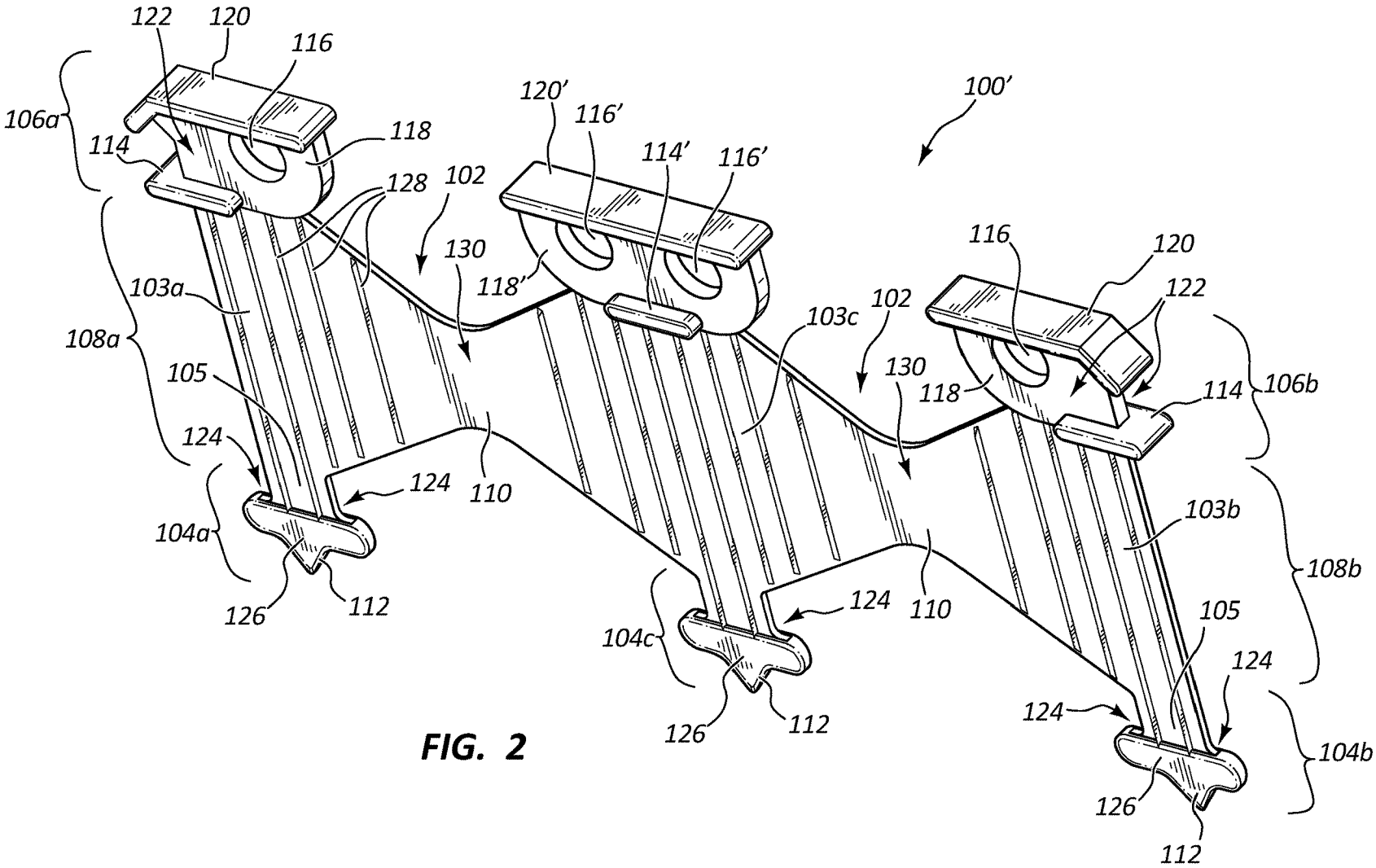
FIG. 2 is a perspective view of another exemplary generally planar insulating tie including features of the present disclosure.

Stated another way, by generally planar, it may be that an average, or even a maximum thickness dimension within the tie, or within given segments of the tie, may be no more than 20%, no more than 10%, no more than 5%, no more than 4%, or no more than 3% of the width and/or length of the tie. For example, the maximum thickness in the penetrating and mesial segments may be no more than 0.4 inch, or no more than 0.25 inch (e.g., typically about 0.125 inch to 0.35 inch thick). The length and/or width of the tie may be at least 4, 5, or 6 inches (e.g., 5 to 10 inches). In such a case, the maximum thickness (e.g., 0.35 inch, or 0.25 inch) is only about 4%, and the average thickness (e.g., just over 0.125 inch, such as 0.15 inch) may only be about 2% of the width and/or length. A tie as illustrated in FIG. 2 may have a width that is about twice that of FIG. 1, with the same thickness dimensions, such that the percentages for the embodiment of FIG. 2 may be about half those described above.

Figure 3A:
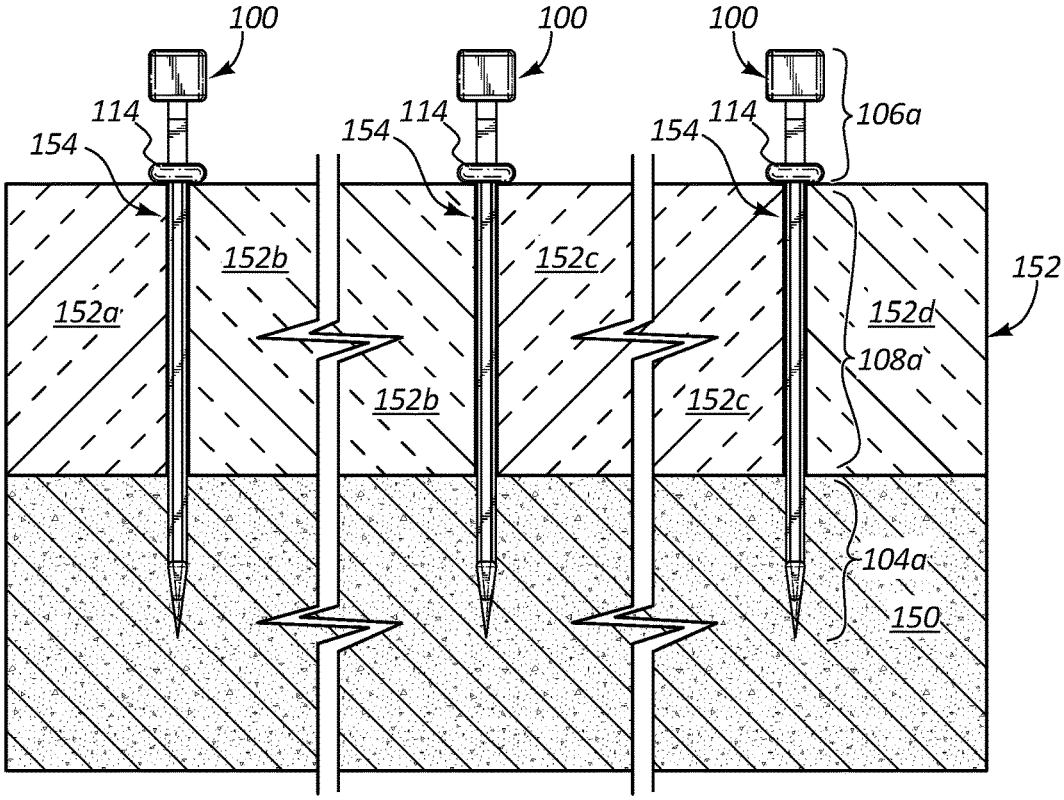
FIG. 3A is an elevation cross-sectional view of a partially completed composite wall structure, showing the generally planar ties of FIG. 1 penetrating into a first structural layer, and with a mesial segment of the ties spanning the insulating layer, where the insulating layer is formed from sheets of insulating material laid on the first structural layer, with the ties positioned in gaps between adjacent insulating sheets of the insulating layer.
Figure 3B:
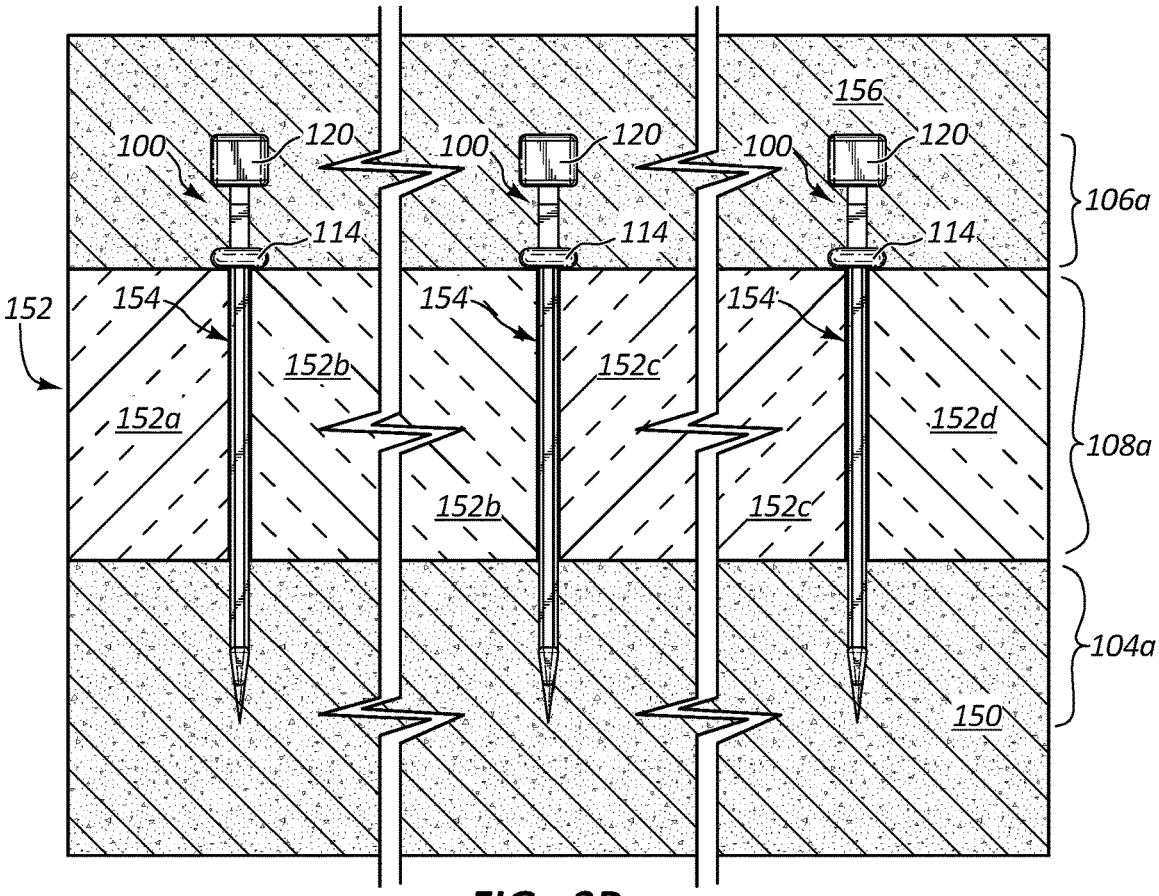
FIG. 3B is an elevation cross-sectional view of a completed composite wall structure according to the present disclosure, similar to that of FIG. 3A, but in which the second structural layer has been formed over the impact segments of the ties, such that the impact segments are embedded within the second structural layer.
Figure 4A:
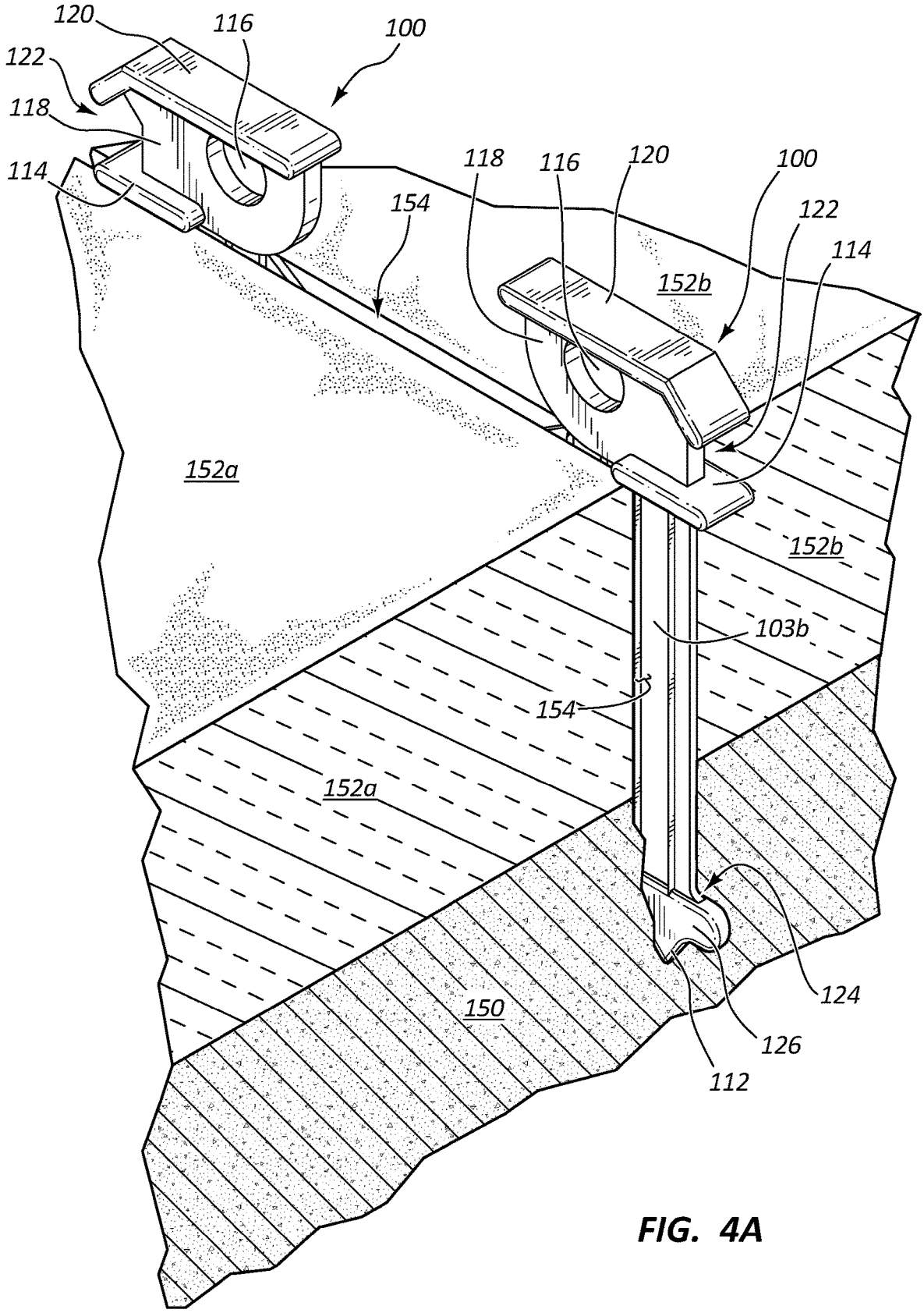
FIG. 4A shows a perspective and partial cross-section view of the tie of FIG. 1, with the penetrating segments of the tie embedded within the first structural layer, shown with two insulating sheets of the insulation layer placed over the first structural layer, with a gap between the sheets, where the tie is positioned in the gap.

As seen in FIG. 1, impact segments 106*a*, 106*b* may include stops or flanges 114 at the boundary between each mesial segment 108*a*, 108*b* and each impact segment 106*a*, 106*b*. Such a flange or other protruding ridge acts as a stop against further advancement of tie 100 between the sheets of the insulating layer. In other words, the user may easily insert (e.g., axially press) the tie 100 between adjacent sheets of the insulating layer until the flange stop 114 contacts the face of the insulating layer, as shown in FIGS. 3A and 4A. The flange 114 thus limits penetration, acting as a stop to ensure that the impact segments 106*a*, 106*b* proximal to flanges 114 remain outside (but adjacent to) the plane defined by the insulating layer, so that the impact segments 106*a*, 106*b* can become embedded within the second structural layer of the composite wall structure.

As will be apparent from FIG. 1, the flange 114 may be the most prominent laterally extending feature of the tie (i.e., extending laterally outward, in the thickness dimension, to the greatest degree). For example, flange 114 may have a lateral thickness relative to the plane defined by the tie that is about 0.5 inch (e.g., protruding about 0.25 inch laterally outward relative to both faces of the plane defined by tie 100). Because the flange 114 does not pass between the sheets, it may of course be wider than such 0.5 inch lateral extension into and out of the wall plane. In any case, flange 114 is configured to stop advancement of tie 100 relative to the insulating layer.

Because tie 100 is configured as a planar tie that is pressed axially into the composite wall construction (e.g., as it is being assembled, layer by layer), rather than rotated or screwed therein as some ties, the tie 100 may not include any driving head shaped and sized for receipt into a corresponding socket of a powered drill or other rotating driving tool.

In addition to flange stops 114, each impact segment is also illustrated as including a structure defining a recess, configured to fill with concrete, so as to resist pull-out of the tie 100 from the second structural layer once second structural layer hardens around such recesses. For example, impact segments 106*a* and 106*b* are shown as including a hole 116 passing through the thickness of a thickened portion 118 at the proximal end of impact segment 106*a*, 106*b*. Thickened portion 118 may have a thickness (e.g., about 0.25 inch) approximately double that of the bridging web 110 (e.g., 0.125 inch) and the other thin portions of tie 100. In addition to hole 116, each impact segment may further include a top flange 120, which may include at least a portion thereof that runs parallel to flange stop 114. Top flange 120 may extend laterally to the same or a similar amount as flange stop 114 (e.g., a thickness of about 0.5 inch total, 0.25 inch from each face of the plane defined by tie 100). A recess 122 for filling with concrete so as to resist pull out (similar to hole 116) is also defined between top flange 120 and flange stop 114

Returning to penetrating segments 104*a*, 104*b*, such segments may also include recessed portions 124 defined on either side of an oval-shaped or other widened base from which pointed tip 112 extends. It will be appreciated that other generally planar recessed portions or similar anchoring means for anchoring the penetrating segment 104*a*, 104*b* within the first structural layer, once that layer has hardened, may be provided. By way of explanation, concrete or other hardenable material may enter into recessed portions 124 (on either side of each widened base 126. Once hardened, concrete in these recessed portions 124 will prevent pull-out of segments 104*a*, 104*b* from the first structural layer. Because these structures of the penetrating segment are generally planar (i.e., they include little thickness relative to the overall length and width of the tie) they do not interfere with the ability to pass this segment of the tie through a narrow gap (e.g., about 0.125 to about 0.25 inch) provided between adjacent foam sheets that make up the insulating layer. For example, the widened base 126 may have a width of about 1 to 2 inches, as compared to the thickness which may only be 0.125 to 0.25 inch. Widened base 126 and/or pointed tip 112 may be tapered towards tip 112, so that the proximal end of widened base 126 adjacent planar shaft portion 105 may be the thickest portion of penetrating segment 104*a*, 104*b*, and narrowing in thickness towards pointed tip 112.

Figure 5A:
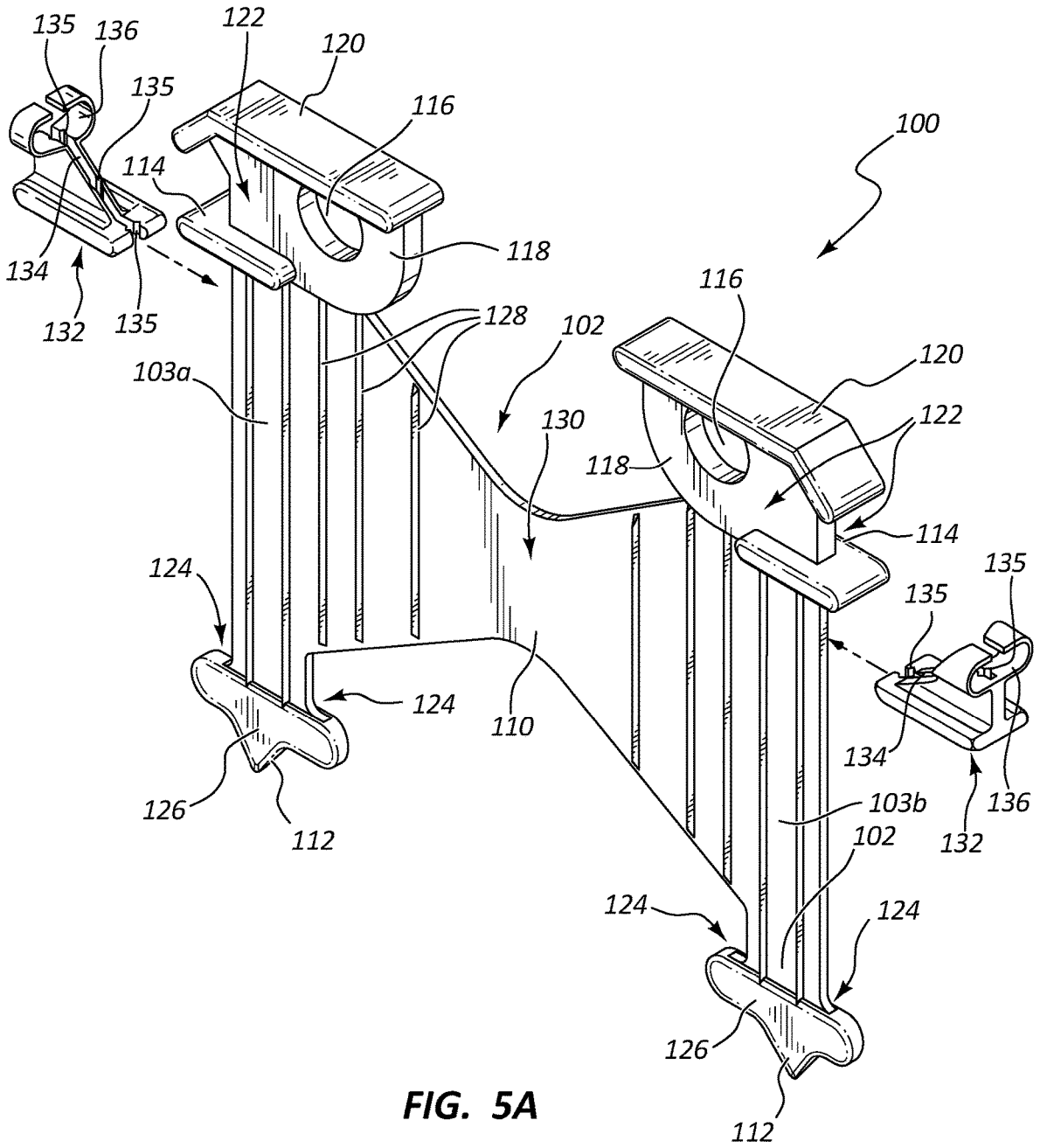
FIG. 5A shows an exploded perspective of the tie of FIG. 1, shown with a sliding spacer for accommodating differences in foam sheet thickness.
Figure 5B:
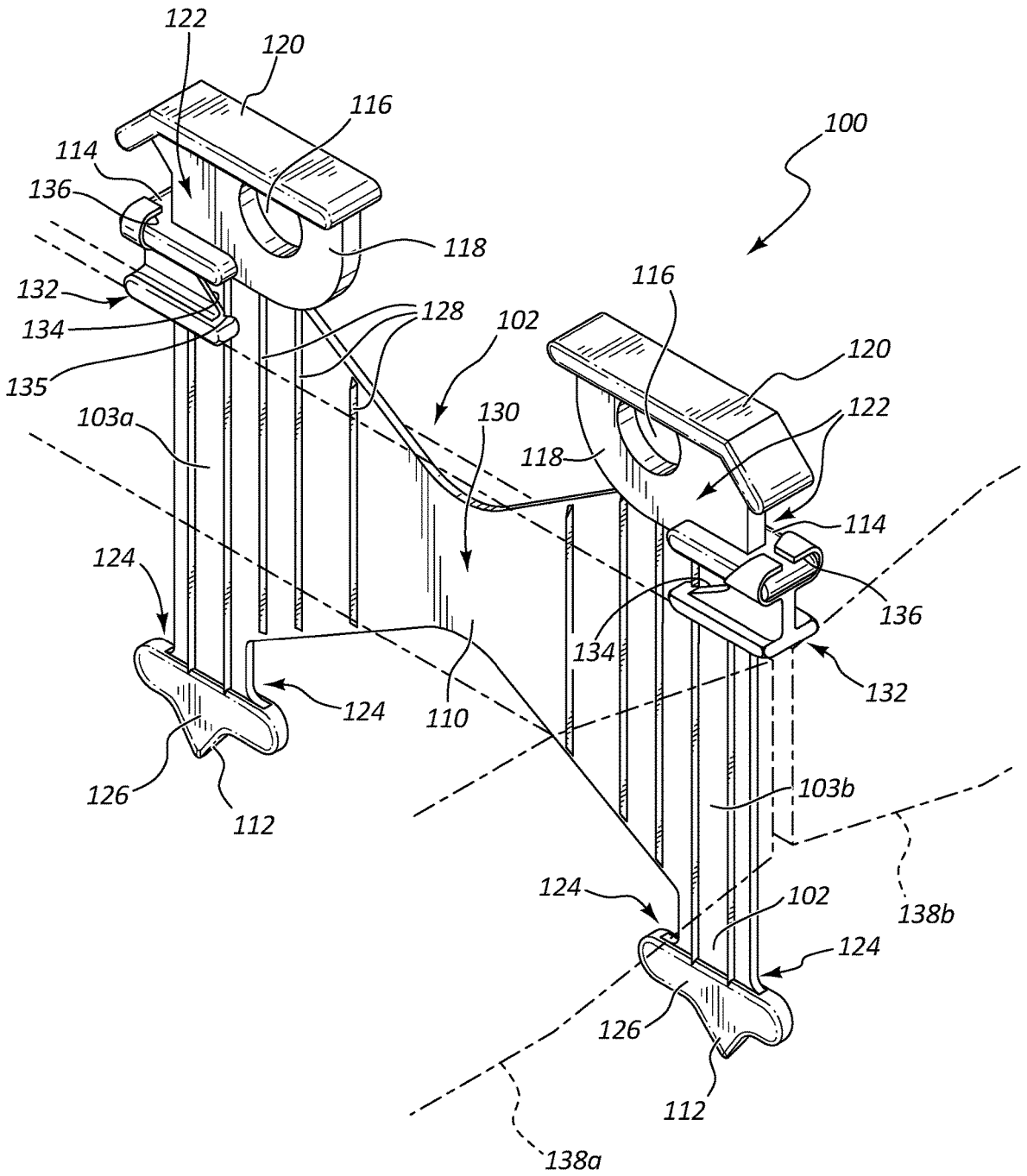
FIG. 5B shows the tie and sliding spacer of FIG. 5A, with the spacer slid over the flange stops of the tie, and with foam sheets shown in phantom.

Mesial segments 108*a*, 108*b*, as well as planar shaft portion 105, and at least a portion of bridging web 110 may include vertical ribs 128, as shown. Such ribbing is shown as extending over the planar portions of mesial segments 108*a*, 108*b*, and planar shaft portion 105, as well as a portion of bridging web 110 that is adjacent mesial segments 108*a*, 108*b*. A central portion 130 of bridging web 110 is shown as being unribbed. FIGS. 5A-5B illustrate how tie 100 may be used in combination with a sliding spacer 132, that includes a horizontal channel 134 that may include vertical grooves 135 spaced and configured to mate with ribs 128. Such a spacer may be helpful when using tie 100 with foam sheets which are tapered or chamfered at their edges, as shown in FIG. 5B.

Sliding spacer 132 is further shown as including a flange receiving through-hole or recess 136 that receives and slides over flange stop 114, from the outside edge thereof, allowing spacer 132 to slide inwardly (and outwardly), using flange stop 114 as a guide as flange stop 114 is received in through-hole recess 136. Channel 134 may receive the planar thickness of mesial segment 108*a*, 108*b*, and channel 134 may thus be about 0.125 inch wide (e.g., the same, or slightly wider than the planar thickness of segment 108*a*, 108*b*, so as to receive and slide over it). Vertical grooves 135 and vertical ribs 128 may be evenly spaced, e.g., about 0.5 inch apart from one another.

A second flange stop 114' is shown as formed about horizontal channel 134, so as to provide a flange stop that is positioned lower than flange stop 114, so as to accommodate the tapering or chamfering of foam sheet 138. In an embodiment, when installed on flange 114, spacer 132 may position second flange stop 114' one inch below flange stop 114, accommodating a 1 inch taper or chamfer in the edge of foam sheet 138. Such a second flange stop and spacer could alternatively be used to accommodate a sheet that is simply thinner throughout (e.g., it may not be tapered or chamfered, but formed so as to have such thinner thickness throughout. For example, the tie may be sized to accommodate a foam sheet having a 4 inch thickness. If tapered or chamfered 1 inch on both faces, the foam sheet 138 would then have a thickness of only 2 inches at the edges. Spacer 132 with a 1 inch spacing between recess 136 (flange 114) and second flange 114' accommodates such a foam sheet. Such a spacer and tie would also accommodate foam sheets that are uniformly 2 inches in thickness. While described in the context of specific dimensions and examples, it will be appreciated that such a spacer could be configured to accommodate any such taper or chamfer (on 1 or both faces), or difference in foam sheet thickness.

Returning to FIG. 2, this figure illustrates a tie otherwise similar to tie 100 of FIG. 1, but which is configured so as to cover approximately double the length. Such tie 100' similarly fits between adjacent sheets of insulation, and includes all the same features as described above relative to tie 100, although it includes three, rather than two, of the penetrating segments, mesial segments, and impact segments. The third set of these segments (located at the center) is designated 103*c* (the third generally planar shaft body), 104*c* (the third penetrating segment), 106*c* (the third impact segment), and 108*c* (the third mesial segment) in FIG. 2. The various other structures of FIG. 2 that are similar to FIG. 1 are labeled identically. Central planar shaft body 103*c* is in some respects somewhat differently configured as compared to bodies 103*a* and 103*b*, simply because it is centrally located in tie 100'. Flange stop 114' is similar to flange stops 114, but is centrally located, rather than at the ends of tie 100', as are flange stops 114. Similarly planar thickened portion 118' is shown as including two holes 116' formed therethrough, rather than the single hole 116 included in each of thickened portions 118. Finally, top flange 120' is shown as entirely parallel with flange 114', not including any distally angled portions, as included in top flanges 120'. Penetrating segment 104*c* may be identically configured as penetrating segments 104*a* and 104*b*, as shown.

FIGS. 6A-6F and FIGS. 7A-7B illustrate alternative ties having a different configuration from that of FIG. 1, but which include similar generally planar features, so as to be particularly configured for sliding between adjacent foam insulation sheets in a wall being constructed. For example, the tie 200 of FIG. 6A similarly includes first and second (e.g., left and right) generally planar shaft body portions 203*a*, 203*b*, each including a penetrating segment (204*a*, 204*b*), an impact segment (206*a*, 206*b*), and a mesial segment (208*a*, 208*b*) disposed therebetween. In tie 200, rather than including a configuration where the first and second impact segments and first and second penetrating segments are not directly connected to one another (i.e., with a gap therebetween), the tie 200 is of a configuration where connections are made left to right across each corresponding segment of the two body portions 203*a*, 203*b*, through web 210. For example, the two impact segments 206*a* and 206*b* (left and right) may actually be continuous, connected to one another without any discontinuities therebetween. The two penetrating segments 204*a*, 204*b* are similarly configured, to be continuously connected to one another without discontinuity. Portions of the mesial segments 208*a*, 208*b* are shown also directly connected (e.g., through what may be termed a bridging web 210, that runs through all 3 segments). For example, the bridging web 210 may simply be considered to be the central portion of the tie 200, between the left and right portions 203*a*, 203*b*. The hole 225 provided in the mesial segment 208*a*/208*b* in web 210 may simply serve to conserve material, reducing the amount of resin used for each tie, without significantly affecting performance or strength characteristics of the tie. The flange 220 positioned in the impact segment resists pull out once the second layer of concrete hardens around this "undercut" feature, similar to the function provided by flange 120 of tie 100. Holes 216 similarly fill with concrete, increasing pull out strength (similar to holes 116). Flange 214 marks the boundary between the impact segment(s) 206*a*, 206*b* and the mesial segment(s) 208*a*, 208*b*. In a configuration such as that of FIGS. 6A-6F, it will be appreciated that the configuration could be described as including a very wide single shaft body 202, which is formed from both left and right shaft body portions 203*a*, 203*b*, given the continuity in the configuration, from left to right, across the 3 segments.

Figure 6A:
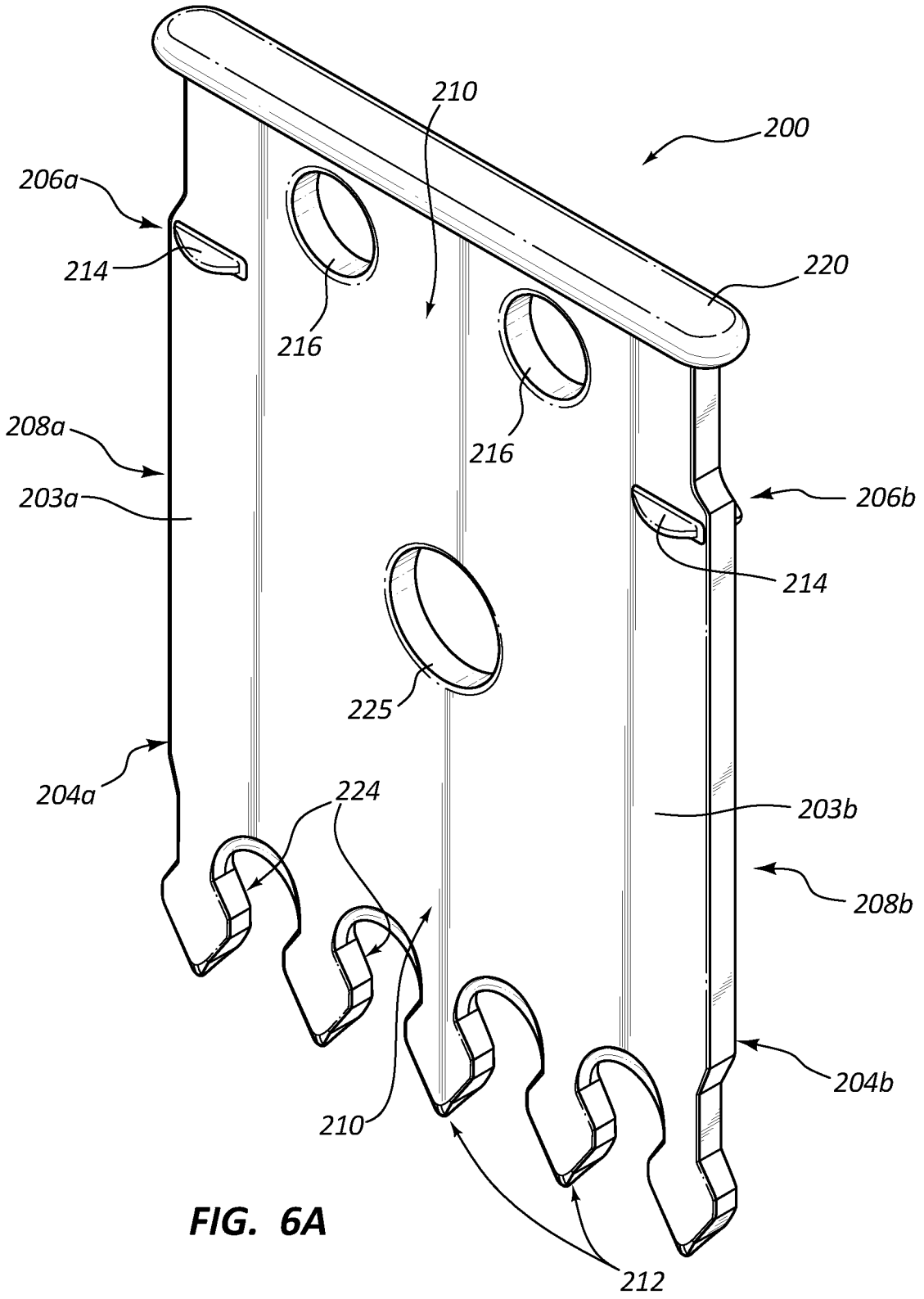
FIGS. 6A-6F show various views of an alternative tie configuration, which is configured to be pressed between adjacent sheets of insulating layers, in substantially the same way as the tie of FIG. 1.
Figure 6B:
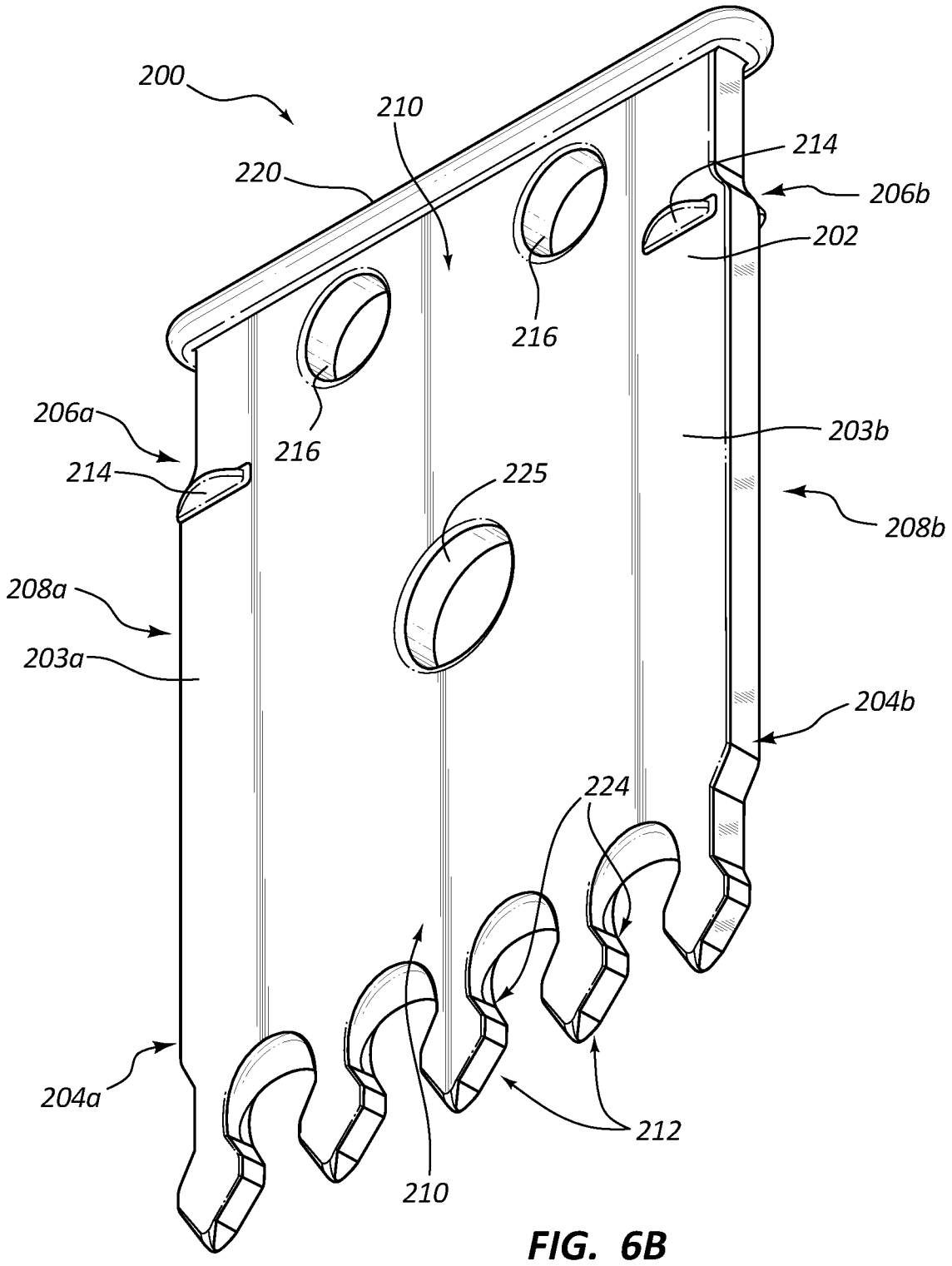
Figure 6E:
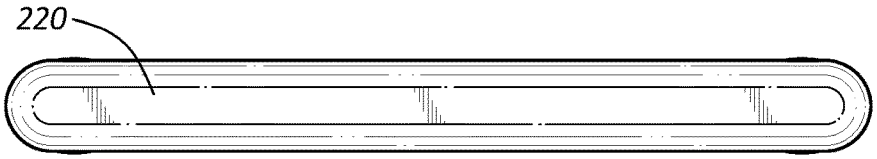
Figure 6C:
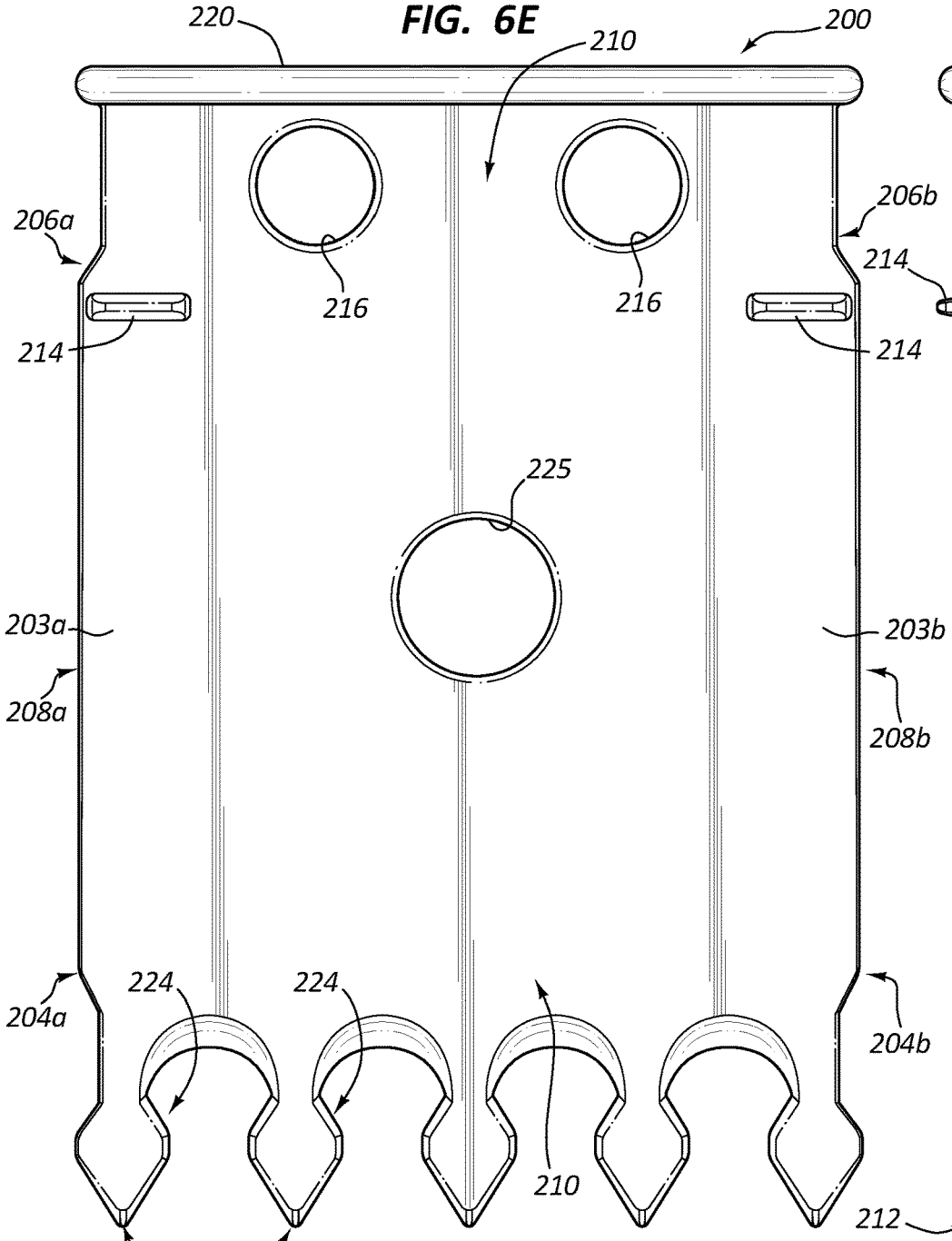
Figure 6D:
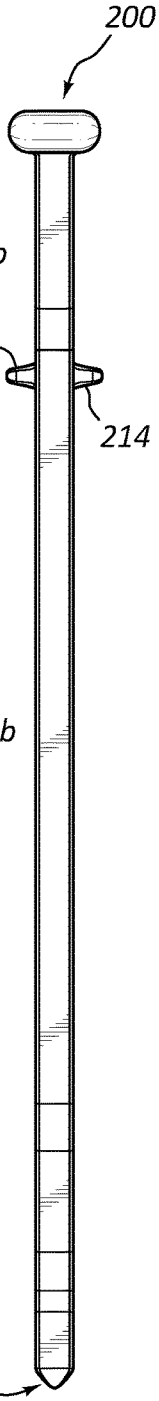
Figure 6F:
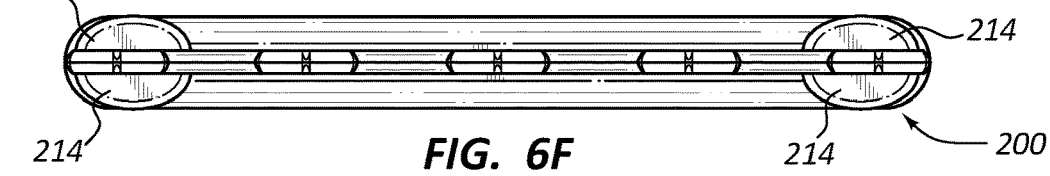
Figure 7A:
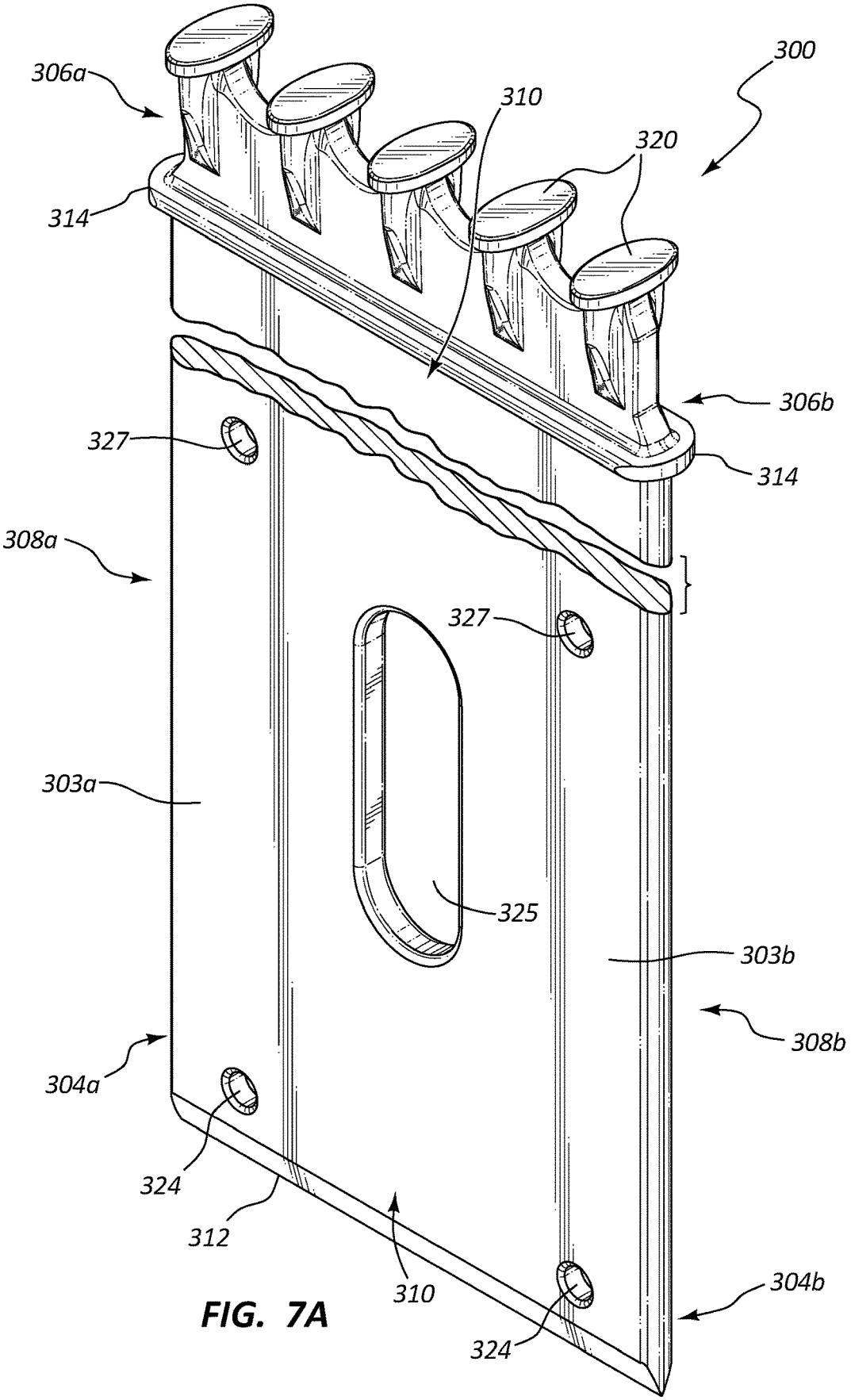
FIGS. 7A-7B show yet another alternative tie configuration, which is configured to be pressed between adjacent sheets of insulating layers, in substantially the same way as the tie of FIG. 1.
Figure 7B:
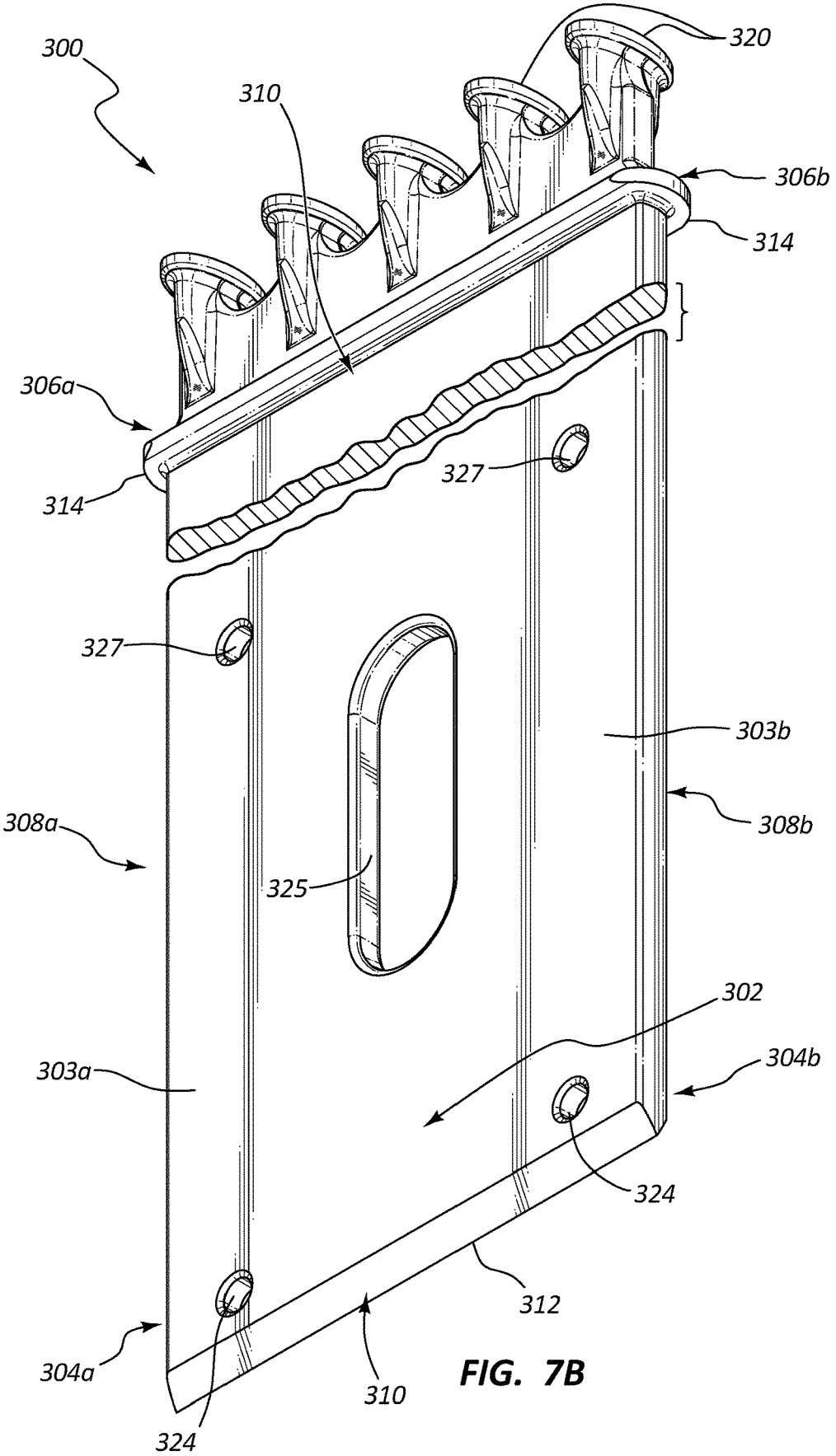

FIGS. 7A-7B illustrate another configuration of a tie 300, in many ways similar to tie 200 of FIGS. 6A-6F. Tie 300 of FIG. 7 similarly includes first and second (e.g., left and right) generally planar shaft body portions 303*a*, 303*b*, each including a penetrating segment (304*a*, 304*b*), an impact segment (306*a*, 306*b*), and a mesial segment (308*a*, 308*b*) disposed therebetween. In tie 300, as in tie 200, the configuration is one in which connections are made left to right across each corresponding segment of the two body portions 303*a*, 303*b*, by web 310. For example, the two impact segments 306*a* and 306*b* (left and right) may actually be continuous, connected to one another without any discontinuities therebetween. The two penetrating segments 304*a*, 304*b* are similarly configured, to be continuously connected to one another without discontinuity. Portions of the mesial segments 308*a*, 308*b* are shown also directly connected (e.g., through what may be termed a bridging web 310, that runs through all 3 segments). For example, the bridging web may simply be considered to be the central portion of the tie, between the left and right portions 303*a*, 303*b*. Holes 324 positioned in the penetrating segment(s) may fill with uncured concrete, so as to resist pull out. The holes 325 and 327 provided in the mesial segment may simply serve to conserve material, reducing the amount of resin used for each tie, without significantly affecting performance or strength characteristics of the tie. The contours and flanges 320 positioned in the impact segment resist pull out once the second layer of concrete hardens around these "undercut" features, similar to the function provided by holes 116 and flanges 120 of tie 100. Flange 314 marks the boundary between the impact segment(s) 306*a*, 306*b* and the mesial segment(s) 308*a*, 308*b*. In tie 300, flange 314 is shown extending across the entire width of tie 300, rather than the short flanges 214, of tie 200 of FIG. 6A-6F. It will be appreciated that both such configurations provide a stop against further insertion of the tie once the entire mesial segment has been pressed into the space between insulating sheets. In a configuration such as that of FIG. 7A (as in FIG. 6A), it will be appreciated that the configuration could be described as including a very wide single shaft body 302, which is formed from both left and right shaft body portions 303*a*, 303*b*, given the continuity in the configuration, from left to right, across the 3 segments.

While FIG. 6A includes a plurality of pointed (but flat, and generally planar) tips 212, FIGS. 7A-7B illustrate a single continuous chisel pointed tip 312, running the full width of tie 300. It will be apparent that various planar tip configurations may be suitable for use, so long as they are not generally conical, emanating from a cylindrical base, which does not permit a generally planar profile. The cut-outs and plurality of spear-shaped tips 212 of FIG. 6A may provide additional undercut surfaces 224 (analogous to recesses 124 of the tie of FIG. 1) in the penetrating segment that will resist pull-out once the concrete hardens.

Each of the illustrated exemplary tie configurations advantageously do not include cylindrical body features in which the cylinder extends axially (i.e., along the "height" of the tie—e.g., as running from the impact segment to the penetrating segment), particularly within the penetrating segment and mesial segment of the tie, as such cylindrical features would interfere with the desired thin, planar profile of the tie, which is configured to be slid between adjacent sheets of the insulating layer, rather than actually penetrating the insulating layer sheets themselves. For example, while Applicant's earlier ties of U.S. Design Patent D764,266 or FIG. 6 of U.S. Publication 2004/0118067 may superficially resemble some of the illustrated exemplary configurations, those earlier configurations include such cylindrical features, which may be expressly excluded from the current configurations, as they make the tie too thick for easy insertion between adjacent sheets of the insulating layer.

Each of the above patent and published application are herein incorporated by reference in its entirety.

The ties may be injection molded from a suitable plastic material. Injection molding of the entire tie from a single, integral piece of molded material is particularly advantageous, as no assembly of individual parts is required, as is typical for many other existing ties. For example, assembly does not require any laying or threading of lengthy fiberglass or carbon fibers, where a an epoxy or similar curable matrix is then injected. Rather, exemplary materials are high strength (e.g., as opposed to inexpensive, weak plastic materials such as polypropylene, polyethylene, etc.), including but not limited to polyphenylsulfone (PPSF), polythalamide, or combinations of various suitable injection moldable materials. Various other suitable materials are disclosed in the patents referenced above, e.g., U.S. Pat. No. 6,854,229, already incorporated by reference. Any such materials, or combinations thereof, may be used. Preferred materials exhibit resistance to alkaline environments, high melt temperatures (e.g., about 700° F. or more), high impact strength, no or minimal shear cracking, high tensile strength, etc. The material employed may be reinforced with glass fibers (e.g., short, discontinuous filler fibers, e.g., less than 5 cm, less than 3 cm, or less than 1 cm in length). In an embodiment, the interior of the mold surfaces may be textured (e.g., sandblasted) to provide a rough surface to the exterior of the tie. Such roughened surface provides for increased pull out strength relative to the concrete into which the tie becomes embedded. For example, an exemplary tie may have a pull out strength of 100 lbs or more.

FIGS. 3A-3B, and 4A-4B further illustrate a method of using ties according to the present invention. For example, an insulating composite wall structure including first and second structural layers and an insulating layer disposed therebetween (e.g., sandwiched) may be formed. The method may include providing a tie (e.g., 100, 100', 200, 300) such as any of those described herein. A first structural layer 150 may be formed from a hardenable high strength structural material (e.g., concrete). An insulating layer 152 comprising a material having a higher thermal resistance than the first structural layer 150 is placed onto a surface of the first structural layer 150 while the first structural layer 150 is in a substantially unhardened state. The insulating layer 152 may be formed of expanded polystyrene sheets or any other suitable insulating material. In an embodiment, the insulating layer may be preformed, e.g., as one or more sheets 152*a*-152*d* positioned over the first structural layer 150. FIG. 3A shows how the ties 100 (or 100', or 200 or 300) are positioned not to penetrate through any of sheets 152*a*-152*d* making up layer 152, but are actually placed between narrow gaps between adjacent sheets. For example, ties are shown between sheets 152*a* and 152*b*, between 152*b* and 152*c*, and between 152*c* and 152*d*. No predrilling, forming holes, or otherwise damaging the sheets is thus needed. The generally planar geometry of the ties, particularly the penetrating segments and impact segments thereof facilitates such "between the sheets" placement.

Ties 100 (or 100', or 200 or 300) are axially pushed into the gaps 154 between such sheets 152*a*-152*d*. Such advancement of the penetrating segments 104*a*, 104*b* of illustrated ties 100 is performed while the first structural layer 150 has not yet fully hardened. As seen, penetrating segment 104*a* (and 104*b*) are positioned in first structural layer 150, while mesial segment 108*a* (and 108*b*) are positioned in the same plane as insulating layer 152, such that the segment and the plane of the insulating layer are co-extensive with one another. Impact segment 106*a* (and 106*b*) reside above insulating layer 152. Ties 100', 200 and 300 would be inserted in a similar manner.

The second structural layer 156 is formed from a hardenable high strength structural material (e.g., concrete) on the exposed surface of the insulating layer 152 such that the substantial portion of the impact segment (e.g., 106) extending from the insulating layer 152 is embedded within the second structural layer (156). The first and second structural layers 150, 156 are allowed to harden, which forms an insulating composite wall structure 158 in which the first structural layer 150, the second structural layer 156, and the insulating layer 152 are secured together by the one or more ties (e.g., 100, or 100', or 200 or 300).

Figure 4B:
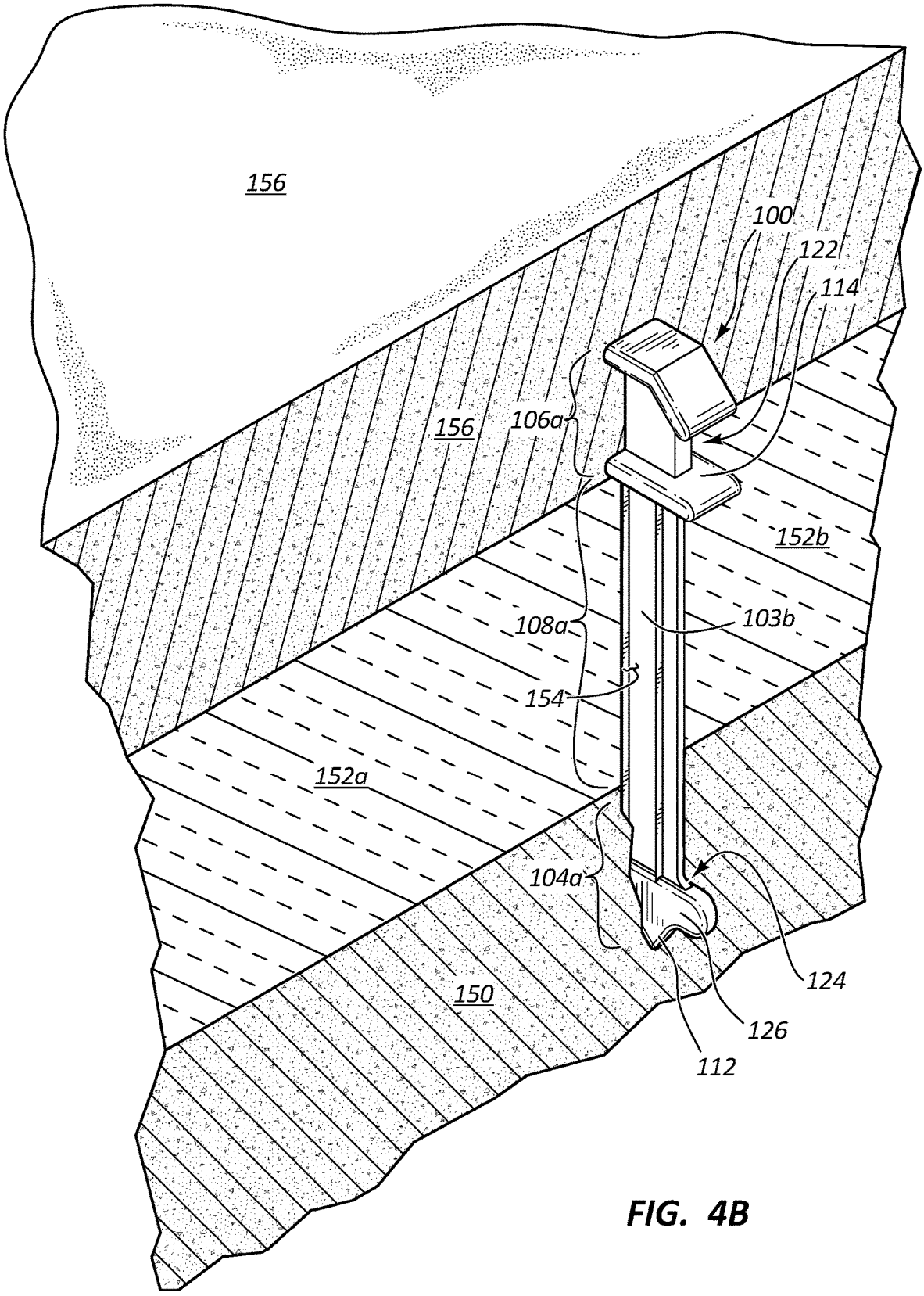
FIG. 4B shows the same structure as in FIG. 4A, but after the second structural layer has been formed (e.g., poured) over the insulating layer, embedding the impact segments of the tie within the second structural layer.

FIG. 4A illustrates a perspective view at a stage similar to that seen in FIG. 3A, where the tie 100 has been slid into narrow gap 154 between sheets 152*a* and 152*b* of insulating layer 152, before second structural layer 156 is poured (or where it simply is not shown). FIG. 4B shows the same configuration, but with second structural layer 156 in place, surrounding or encasing impact segment 106*a* (and 106*b*).

Where the ties are used in a tilt-up construction scheme, the first structural layer 150 may be poured, followed by placement of insulating layer 152 thereover. While layer 150 is still unhardened, ties 100 may be advanced through layer 152, into layer 150. Once ties are in place, the second structural layer 156 may then be poured over insulating layer 152. Tilt-up construction schemes may be preferred.

Where the ties are used in a cast-in-place construction scheme, the first and structural layers may be poured one after the other, or simultaneously. The ties may be advanced through the insulating layer 152 (between sheets thereof) either before, during, or after pouring of the concrete of structural layers 150, 156. In any case, the ties 100 are positioned within the structural layers 150 and 156 before layers 150 and 156 have hardened. For example, the casting forms could be assembled, sheets of insulating layer 152 could be inserted into the casting forms (with channels on either side for pouring of structural layers 150, 156). The ties could be inserted between narrow gaps (e.g., 0.125 to 0.5 inch) between sheets of the insulating layer at this point, before concrete is poured for structural layers 150, 156. Once ties (100, or 100', or 200 or 300) are in place, the structural layers 150, 156 could be poured (e.g., simultaneously), or one after the other.

Ties may be spaced at any desired intervals to achieve a desired level of strength or composite action with the wall. The width of insulating sheets may be determined also based on the desired spacing between ties. Relatively closer spacing increases the composite action and/or strength of the resulting composite wall. Typically the first structural layer 150 may be relatively thin (e.g., about 3 inches), while the second structural layer 156 may be significantly thicker (e.g., 6 to 12 inches). In such configurations, the second structural layer provides the necessary strength, so that the first structural layer may simply be a fascia layer. In such instances, the ties may only need to provide a relatively small degree of composite action (e.g., 10-20% composite action, such as 15%).

Numbers, percentages, or other values stated herein are intended to include that value, and also other values that are about or approximately the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing process, and may include values that are within 25%, within 20%, within 10%, within 5%, within 1%, etc. of a stated value. Furthermore, the terms "substantially", "similarly", "about" or "approximately" as used herein represents an amount or state close to the stated amount or state that still performs a desired function or achieves a desired result. For example, the term "substantially" "about" or "approximately" may refer to an amount that is within 25%, within 20%, within 10% of, within 5% of, or within 1% of, a stated amount or value.

Ranges between any values disclosed herein are contemplated and within the scope of the present disclosure (e.g., a range defined between any two values (including end points of a disclosed range) given as exemplary for any given parameter).

As used in this specification and the appended claims, the singular forms "a," "an" and "the" include plural referents unless the context clearly dictates otherwise.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A tie for use in making an insulating composite wall structure including first and second structural layers comprising hardenable material and an insulating layer having a high thermal resistance disposed between the first and second structural layers, the tie comprising:

a body including first and second shaft bodies, each shaft body including a penetrating segment, an impact segment, and a mesial segment extending therebetween, such that the body includes a pair of penetrating segments, a pair of impact segments, and a pair of mesial segments, wherein the pair of mesial segments are joined together by a bridging web that bridges between the first and second shaft bodies;

a pointed tip at an end of each of the penetrating segments configured to penetrate between adjacent sheets of the insulating layer;

wherein at least the penetrating segments, the mesial segments, and the bridging web of the tie are generally planar, each having a maximum thickness that is no more than 0.4 inch, so as to fit between adjacent sheets of the insulating layer.

2. The tie as in claim 1, wherein the pointed tip is generally planar in the same plane as at least the penetrating segments.

3. The tie as in claim 1, wherein the maximum thickness of each of at least the penetrating segments, the mesial segments, and the bridging web of the tie is from about 0.0625 inch to 0.4 inch, so as to fit between adjacent sheets of the insulating layer.

4. The tie as in claim 1, wherein the maximum thickness of each of at least the penetrating segments, the mesial segments, and the bridging web of the tie is no more than 0.25 inch, so as to fit between adjacent sheets of the insulating layer.

5. The tie as in claim 1, wherein the maximum thickness of each of at least the penetrating segments and the mesial segments is no more than 10% of at least one of a length or width of the tie.

6. The tie as in claim 1, wherein the maximum thickness of each of at least the penetrating segments and the mesial segments is no more than 5% of at least one of a length or width of the tie.

7. The tie as in claim 1, wherein the maximum thickness of each of at least the penetrating segments, the mesial segments, and the bridging web of the tie is no more than 10% of at least one of a length or width of the tie.

8. The tie as in claim 1, wherein the impact segments each comprise a thickened portion having a thickness greater than the bridging web, both the thickened portion and the bridging web being planar but for vertical ribbing on the bridging web.

9. The tie as in claim 8, wherein each thickened portion further comprises a hole arranged to permit uncured concrete to flow therein, preventing pull out of the impact segment from the second structural layer after the second structural layer has hardened.

10. The tie as in claim 1, wherein the impact segments each comprise a flange stop at a distal end thereof, between the impact segment and the mesial segment.

11. The tie as in claim 10, further comprising a sliding spacer separate from a remainder of the tie, the sliding spacer including a channel sized and configured to slidably receive the generally planar mesial segment therein, the sliding spacer further including a recess above the channel that slidably receives the flange stop, coupling the sliding spacer to the remainder of the tie.

12. The tie as in claim 11, wherein the sliding spacer further comprises vertical grooves formed in the channel, the vertical grooves being spaced and sized to mate with vertical ribs formed on the mesial segment.

13. A tie for use in making an insulating composite wall structure including first and second structural layers comprising hardenable material and an insulating layer having a high thermal resistance disposed between the first and second structural layers, the tie comprising:

a body including left and right shaft body portions, the left and right shaft body portions each including a penetrating segment, an impact segment, and a mesial segment extending therebetween, such that the body includes a right penetrating segment, a right impact segment, a right mesial segment, a left penetrating segment, a left impact segment, and a left mesial segment wherein the left and right shaft body portions are joined together by a bridging web that bridges between the left and right shaft body portions;

a pointed tip confined to the same plane as a plane defining the mesial and penetrating segments, at an end of each of the penetrating segments, configured to penetrate between adjacent sheets of the insulating layer;

wherein at least the penetrating segments, the mesial segments, and the bridging web of the tie are generally planar, each having a maximum thickness that is no more than 0.4 inch, so as to fit between adjacent sheets of the insulating layer.

14. The tie as in claim 13, wherein the maximum thickness of each of at least the penetrating segments, the mesial segments, and the bridging web of the tie is from about 0.0625 inch to 0.4 inch, so as to fit between adjacent sheets of the insulating layer.

15. The tie as in claim 13, wherein the maximum thickness of each of at least the penetrating segments, the mesial segments, and the bridging web of the tie is no more than 0.25 inch, so as to fit between adjacent sheets of the insulating layer.

16. The tie as in claim 13, wherein the maximum thickness of each of at least the penetrating segments, the mesial segments, and the bridging web of the tie is from about 0.0625 inch to 0.4 inch, so as to fit between adjacent sheets of the insulating layer, the tie having an aspect ratio of width to thickness that is at least 10:1.

17. The tie as in claim 13, wherein the impact segments each comprise a flange stop at a distal end thereof, between the impact segment and the mesial segment, which flange stop extends out laterally from the plane defined by the mesial segment.

18. The tie as in claim 13, wherein each impact segment further comprises a hole arranged to permit uncured concrete to flow therein, preventing pull out of the impact segment from the second structural layer after the second structural layer has hardened.

19. An insulating composite wall structure comprising:

a first structural layer of hardened high strength structural material;

a second structural layer of hardened high strength structural material;

an insulating layer comprising a material having a higher thermal resistance than the first and second structural layers disposed between the first and second structural layers, the structural layers being secured together by one or more ties as recited in claim 1.

20. A method for manufacturing an insulating composite wall structure including first and second structural layers and an insulating layer disposed between the first and second structural layers in a desired configuration, the method comprising:

providing a tie comprising:

a body including first and second shaft bodies, each shaft body including a penetrating segment, an impact segment, and a mesial segment extending therebetween, such that the body includes a pair of penetrating segments, a pair of impact segments, and a pair of mesial segments, wherein the pair of mesial segments are joined together by a bridging web that bridges between the first and second shaft bodies;

a pointed tip at an end of each of the penetrating segments for penetrating between adjacent sheets of the insulating layer;

wherein at least the penetrating segments, the mesial segments, and the bridging web of the tie are generally planar, each having a maximum thickness that is no more than 0.4 inch, so as to fit between adjacent sheets of the insulating layer;

forming the first structural layer from a hardenable high strength structural material;

positioning an insulating layer comprising a material having a higher thermal resistance than the first structural layer against a surface of the first structural layer while the first structural layer is in a substantially unhardened state;

advancing one or more of the ties between adjacent sheets of the insulating layer so that the ties do not substantially penetrate the sheets of the insulating layer;

wherein the penetrating segments of each tie penetrate and are embedded within the first structural layer, such that the mesial segment is disposed substantially between adjacent sheets of the insulating layer, and such that a substantial portion of each impact segment extends outwardly from between sheets of the insulating layer;

forming the second structural layer from a hardenable high strength structural material on an exposed surface of the insulating layer such that the substantial portion of the impact segment extending from between the sheets of the insulating layer is embedded within the second structural layer; and allowing the first and second structural layers to become substantially hardened, thereby forming the insulating composite wall structure in which the first structural layer, and the second structural layer are secured together by the one or more ties.

21. The method as in claim 20, wherein the method for manufacturing an insulating composite wall structure comprises a tilt-up method.

* * * * *